US007163783B2

(12) United States Patent
Seki

(10) Patent No.: US 7,163,783 B2
(45) Date of Patent: Jan. 16, 2007

(54) RINSE-PROCESSING COMPOSITION FOR PROCESSING SILVER HALIDE COLOR PHOTOGRAPHIC MATERIAL, PROCESSING APPARATUS AND PROCESSING METHOD

(75) Inventor: Hiroyuki Seki, Kanagawa (JP)

(73) Assignee: Fuji Photo Film Co., Ltd., Minami Ashigara (JP)

( * ) Notice: Subject to any disclaimer, the term of this patent is extended or adjusted under 35 U.S.C. 154(b) by 0 days.

(21) Appl. No.: 10/226,180

(22) Filed: Aug. 23, 2002

(65) Prior Publication Data

US 2004/0043340 A1 Mar. 4, 2004

(30) Foreign Application Priority Data

Aug. 23, 2001 (JP) ..... 2001-253095

(51) Int. Cl.
*G03C 7/30* (2006.01)

(52) U.S. Cl. ..... 430/463

(58) Field of Classification Search ..... 430/463
See application file for complete search history.

(56) References Cited

U.S. PATENT DOCUMENTS 4,830,948 A * 5/1989 Ishikawa et al. ..... 430/372
5,534,395 A 7/1996 Kamada et al.
5,645,980 A 7/1997 McGuckin et al.
6,475,970 B1 * 11/2002 Del Duca et al. ..... 510/375
6,838,234 B1 * 1/2005 Seki ..... 430/463

FOREIGN PATENT DOCUMENTS

| | | | |
|---|---|---|---|
| EP | 0 519 190 A1 | | 12/1992 |
| EP | 0 651 048 | * | 5/1995 |
| EP | 0 935 166 A2 | | 8/1999 |
| JP | 11-174646 A | | 7/1999 |
| JP | 11-194463 A | | 7/1999 |
| JP | 11-202459 A | | 7/1999 |
| JP | 11-295864 A | | 10/1999 |
| JP | 2000-098567 A | | 4/2000 |
| WO | WO 99/42547 | * | 8/1999 |

OTHER PUBLICATIONS

EPO Search Report dated Sep. 30, 2002 in EP Application No. 02018919.7-2115.

* cited by examiner

*Primary Examiner*—Hoa Van Le
(74) *Attorney, Agent, or Firm*—Buchanan Ingersoll & Rooney PC

(57) ABSTRACT

A rinse-processing composition of the present invention comprises a compound represented by R—$(OC_2H_4)_n$—OH, wherein R is an alkyl group containing 8 to 13 carbon atoms and n is an integer of 10 to 30, but comprises neither aldehyde compounds nor hexamethylenetetramine derivatives, and a processing method and a processing apparatus of the present invention uses such a rinse-processing composition.

10 Claims, 1 Drawing Sheet

RINSE-PROCESSING COMPOSITION FOR PROCESSING SILVER HALIDE COLOR PHOTOGRAPHIC MATERIAL, PROCESSING APPARATUS AND PROCESSING METHOD

FIELD OF THE INVENTION

The present invention relates to photographic processing of silver halide photographic materials and, more particularly, to a rinse-processing composition designed with attention to environmental safety and chemical resistance of materials from which an automatic processor is constructed. Further, the invention is concerned with an automatic processor and a processing method for silver halide color photographic materials, wherein the rinse-processing composition described above is used.

BACKGROUND OF THE INVENTION

As there has been growing public awareness of global environmental protection in recent years, improvement in environmental safety has been required in the photographic processing field also. One approach to this requirement in the photographic industry is through an effort to control the discharge of waste photographic processing solutions to the reduction limit of environmental load. Another approach is through the removal or control of formaldehyde used at the step of using a stabilization bath for the purpose of ensuring environmental safety. And the arts relating to the individual purposes have been introduced.

With respect to the use of formaldehyde substitutes for removal of formaldehyde from a rinsing solution or reduction of formaldehyde concentration in a rinsing solution, for instance, the rinsing or stabilizing solution using hexamethylenetetramine is proposed in Japanese Patent Laid-Open No. 295864/1999, and those using hydroxybenzaldehyde and hexamethylenetetramine derivatives are proposed in Japanese Patent Laid-Open No. 2000-98567.

In addition to formaldehyde, concerns has been pointed out lately that nonylphenoxypoly(ethyleneoxy) compounds acting as surfactants for draining water off the stabilizing bath impair the safety of a living environment in conjunction with physiological metabolism disturbing substances. Therefore, it has been desired to use those compounds in reduced amounts, preferably to use alternative surface tension reducing compounds whose environmental safety is confirmed. For instance, the use of 4-halophenol derivatives as the alternatives is proposed in Japanese Patent Laid-Open No. 174646/1999.

However, a new problem was found that the processing of color photographic materials with an environmental safety-supported rinsing solution free of nonylphenoxy-poly(ethyleneoxy) compounds and containing a formaldehyde substitute gave rise to milky turbidity, deformation, embrittlement and cracking in the rubber and plastic materials used as piping hose materials and valve sealing materials of an automatic processor; as a result, leaks of the rinsing solution and drop in replenishing accuracy tended to occur.

Further, shop laboratories (mini laboratories), or camera shops having a compact automatic processor installed near the entrances thereof and carrying out processing of photographic materials, have proliferated in recent years for the purposes of supporting the need for speeding up services to general users, especially the need for making photo prints from digital cameras, and rationalizing the pickup, delivery and transport operations performed on both camera shop side and laboratory side. As speedy services to customers are important to shop laboratories, the demand for reduction in development time has grown, especially in silver-salt photography. Therefore, rapid processing, or reduction in processing time, has come to be performed by heightening the concentrations of processing solutions and/or processing temperatures.

It has also been recognized that, when the rapid processing under a condition of high concentration and/or high temperature was performed by use of the rinsing solution free of both formaldehyde and nonylphenoxy compounds, automatic processor members were considerably susceptible to degradation.

Accordingly, it has been desired to solve the aforementioned problem by offering a rinsing solution to which measures to environmental safety have been introduced and, at the same time, which has been prevented from causing troubles in the processor.

SUMMARY OF THE INVENTION

The invention has been made from the background mentioned above, and an aim of the invention is to provide a rinse-processing composition not containing materials to cause environmental safety concerns at the time when silver halide color photographic materials, especially color negative photosensitive materials, undergo processing, and besides, causing no degradation in materials from which an automatic processor is constructed. Another aim of the invention is to offer a processing method and an automatic processor of using such a rinse-processing composition.

More specifically, the invention aims at providing a rinse-processing composition used in photographic processing of silver halide photographic materials, which does not contain any of aldehyde compounds, hexamethylenetetramine derivatives and nonylphenoxy compounds, and what is more, obviates defects of causing degradation in piping hose materials and valve sealing materials of an automatic processor, rinsing solution leaks and drop in replenishing accuracy, and further offering a method of processing silver halide photographic materials by use of the rinse-processing composition mentioned above.

As a result of our intensive studies to enhance resistance of automatic processor-constructing materials including plastics and rubbers, especially rubbers, to chemical attack by a rinsing solution using neither aldehyde compounds nor nonylphenoxy compounds, it has been found that the resistance to degradation of the materials can be considerably enhanced by adding to a rinsing solution a polyoxyethylene alkyl ether having a 8–13C alkyl group and a polyoxyethylene group having a length balancing with the length of the alkyl group. On the basis of this finding, our study has been redoubled to result in completion of the invention. Specifically, the aims of the invention are attained by the followings.

(1) A rinse-processing composition for processing a silver halide color photographic material, which comprises at least one compound represented by formula (I) and is free of both aldehyde compounds and hexamethylenetetramine derivatives:

$$R—(OC_2H_4)_n—OH \quad (I)$$

wherein R represents an alkyl group containing 8 to 13 carbon atoms, and n represents an integer of 10 to 30.

(2) The rinse-processing composition for processing a silver halide color photographic material as described in (1), which further comprises at least one compound represented by formula (II):

(II)

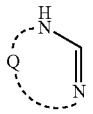

wherein Q represents non-metal atoms for forming an unsubstituted or substituted 5-membered ring.

(3) The rinse-processing composition for processing a silver halide color photographic material as described in (1), wherein R in the formula (I) represents an alkyl group containing 8 to 10 carbon atoms.

(4) The rinse-processing composition for processing a silver halide color photographic material as described in (1), wherein n in the formula (I) represents 1.2 to 4.0 times the number of carbon atoms in R.

(5) The rinse-processing composition for processing a silver halide color photographic material as described in (2), wherein the 5-membered ring in Q of the formula (II) is an imidazole ring, a 2-imidazoline ring, a 1H-1,2,4-triazole ring, a 1H-1,2,3-triazole ring, a 2H-1,2,3-triazole ring, a 4H-1,2,4-triazole ring, a tetrazole ring, a thiadiazole ring, an oxadiazole ring or a selenadiazole ring.

(6) An automatic processor for processing a silver halide color photographic material, which has a mechanism for performing a replenishment of a rinsing solution by feeding a rinse-processing composition as described in (1) and dilution water independently to a rinsing tank directly.

(7) An automatic processor for processing a silver halide color photographic material, which has a mechanism for performing a replenishment of a rinsing solution by feeding a rinse-processing composition as described in (2) and dilution water independently to a rinsing tank directly.

(8) A method for processing a silver halide color photographic material, which comprises processing the silver halide color photographic material with the automatic processor as described in (6), wherein a rinse-processing composition as described in (1) is used at a rinsing step.

(9) A method for processing a silver halide color photographic material, which comprises processing the silver halide color photographic material with the automatic processor as described in (7), wherein a rinse-processing composition as described in (2) is used at a rinsing step.

(10) The method for processing a silver halide color photographic material as described in (8), wherein the silver halide color photographic material is a color photographic material (a color photosensitive material) for picture taking.

(11) The method for processing a silver halide color photographic material as described in (10), wherein the color photographic material for picture taking is a color negative photographic material (a color negative photosensitive material).

Although the compounds of formula (I) belong among polyethylene glycol alkyl ethers which are known to be used in photographic processing solutions, their ethylene oxide chains have their respective lengths in a specified range and the number of carbon atoms contained in their individual alkyl groups is also in a specified range. From the other point of view, it is said that the hydrophilic moiety and the hydrophobic moiety of each compound are balanced by having their molecular weights and chain lengths in the ranges specified respectively. And it has been found that, as far as the polyethylene glycol alkyl ether incorporated in a rinse-processing composition has its hydrophilic and hydrophobic moieties within the scope defined in formula (I), the processing with a rinsing solution free of a nonylphenoxy compound, formaldehyde and hexamethylenetetramine and subsequent rapid drying can ensure the same degradation level as attained by the current standard processing. The term "degradation" used herein is intended to include roller marks on the surface of a photosensitive material, curl setting, deformation localized on the fringes of a photosensitive material, and scum on image areas. By contrast, even in the cases of using polyethylene glycol alkyl ethers, so far as the esters are beyond the confines of formula (I), photosensitive materials come to have significant degradation in the roller marks on their surfaces, curling, deformation localized on the fringes thereof and scum on image areas when undergo rinsing and drying operations. Although the mechanism of those effects produced by surfactants within the range specified in formula (I) is unknown, it is supposed that those effects are pertinent to multiple factors including changes in liquid properties, such as surface tension, which are accompanied by a change of surfactants, changes caused in swelling rate of the photosensitive material surface by removal of ingredients, such as formaldehyde, and changes in drying speed under different drying conditions.

Though the rinse-processing composition containing the polyethylene glycol alkyl ether defined by formula (I) has excellent features as mentioned above, it turned out also that the composition had a drawback of promoting degradation of rubber materials from which developing apparatus members, such as a replenishment valve and a piping hose, are constructed. However, the degradation of the developing apparatus members can be inhibited noticeably when a particular polyazole compound represented by formula (II) is present together with the compound of formula (I) in the rinse-processing composition, thereby enabling the processing which retains highly accurate replenishment and suffers no liquid leaks.

Therefore, the present method for processing color photographic materials, which uses a rinse-processing composition containing polyethylene glycol alkyl ether of formula (I) in combination with a polyazole compound represented by formula (II), is especially suitable for rapid processing which involves rapid drying at high temperatures and tends to promote degradation of materials from which developing apparatus is constructed. Accordingly, the present rinse processing can be used to particular advantage in shop laboratories which have difficulty in taking measures for environmental safety of compounds from the viewpoint of working and equipment management and are required to offer rapid support services to customers.

In addition, the present processing composition and method are applicable to a wide variety of color photosensitive materials, and can produce great effects when applied to color photosensitive materials for picture taking, especially color negative photographic materials which are shorter in processing time and lower in replenishment rate than color reversal materials.

Figure 1:
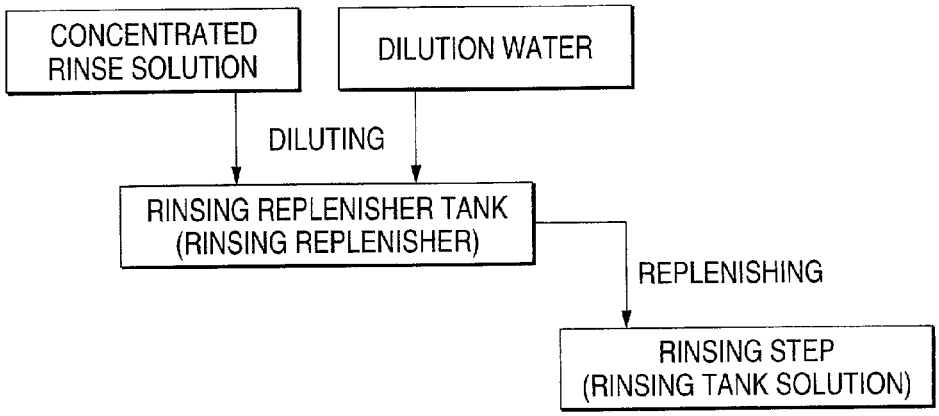
FIG. 1 is a diagram showing a conventional mechanism for performing a replenishment.

The invention is described below in greater detail.

DETAILED DESCRIPTION OF THE INVENTION

The term "rinse-processing composition" used in the invention is intended to include processing solutions for a rinsing bath used at the rinsing step, namely a rinsing solution and a replenisher for rinsing, and prepared chemicals for rinse processing. The prepared chemicals include both concentrated liquid processing chemicals and solid processing chemicals. Further, the prepared chemicals refer to a part of chemicals incorporated in a processing kit for a series of color processing steps in addition to a single chemical for preparation of a rinse-processing solution.

In general the rinsing step is an image-stabilizing step serving as a washing step also, namely a step at which the processing is performed with a stabilizing bath as an alternative to washing water. Accordingly, the rinsing solution is substantially the same as a processing solution previously referred to as a stabilizer (a stabilizing solution), except that additional washing is not always required after the rinse processing. In this sense, the scope of application of a processing composition and a processing method relating to the invention extends to a liquid bath referred to as a stabilizing solution as far as the present effects can be achieved.

The composition of a rinsing solution used in the invention is described below in detail. First, compounds represented by formula (I) are illustrated. In formula (I), R is an alkyl group containing 8 to 13 carbon atoms, which may have a linear or branched structure. And n is a number from 10 to 30, preferably a number 1.2 to 4 times, especially 1.5 to 3.5 times, greater than that of carbon atoms contained in R. Examples of a compound represented by formula (I) are illustrated below.

(I-1) $(n)C_8H_{17}—(OC_2H_4)_{10}—OH$
(I-2) $(n)C_8H_{17}—(OC_2H_4)_{15}—OH$
(I-3) $(n)C_8H_{17}—(OC_2H_4)_{20}—OH$
(I-4) $(n)C_8H_{17}—(OC_2H_4)_{25}—OH$
(I-5) $(n)C_8H_{17}—(OC_2H_4)_{30}—OH$
(I-6) $(n)C_9H_{19}—(OC_2H_4)_{12}—OH$
(I-7) $(n)C_9H_{19}—(OC_2H_4)_{15}—OH$
(I-8) $(n)C_9H_{19}—(OC_2H_4)_{20}—OH$
(I-9) $(n)C_9H_{19}—(OC_2H_4)_{25}—OH$
(I-10) $(n)C_9H_{19}—(OC_2H_4)_{30}—OH$
(I-11) $(n)C_9H_{19}—(OC_2H_4)_{35}—OH$
(I-12) $(n)C_{10}H_{21}—(OC_2H_4)_{15}—OH$
(I-13) $(n)C_{10}H_{21}—(OC_2H_4)_{20}—OH$
(I-14) $(n)C_{10}H_{21}—(OC_2H_4)_{25}—OH$
(I-15) $(n)C_{10}H_{21}—(OC_2H_4)_{30}—OH$
(I-16) $C_{12}H_{25}—(OC_2H_4)_{20}—OH$
(I-17) $C_{12}H_{25}—(OC_2H_4)_{30}—OH$
(I-18) $CH_3(CH_2)_3CH(C_2H_5)CH_2—(OC_2H_4)_{15}—OH$
(I-19) $CH_3(CH_2)_3CH(C_2H_5)CH_2—(OC_2H_4)_{20}—OH$
(I-20) $CH_3(CH_2)_3CH(C_2H_5)CH_2—(OC_2H_4)_{25}—OH$
(I-21) $CH_3(CH_2)_3CH(C_2H_5)CH_2—(OC_2H_4)_{30}—OH$
(I-22) $CH_3(CH_2)_3CH(C_3H_7)CH_2—(OC_2H_4)_{30}—OH$
(I-23) $CH_3(CH_2)_3CH(C_2H_5)CH_2—(OC_2H_4)_{30}—OH$
(I-24) $CH_3(CH_2)_6CH(CH_3)—(OC_2H_4)_{30}—OH$
(I-25) $CH_3(CH_2)_3CH(CH_3)_2CH_2—(OC_2H_4)_{30}—OH$
(I-26) $CH_3(CH_2)_5CH(CH_3)CH_2—(OC_2H_4)_{25}—OH$
(I-27) $CH_3(CH_2)_6CH(CH_3)—(OC_2H_4)_{25}—OH$
(I-28) $C_2H_5C(CH_3)_2CH_2C(CH_3)_2CH_2C(CH_3)_2—(OC_2H_4)_{10}—OH$
(I-29) $C_2H_5C(CH_3)_2CH_2C(CH_3)_2CH_2C(CH_3)_2—(OC_2H_4)_{15}—OH$

Of the compounds illustrated above, Compounds (I-1), (I-6), (I-12) and (I-16) are preferred over the others. In particular, Compounds (I-1), (I-6) and (I-12) wherein the number of carbon atoms contained in R is from 8 to 10 are advantageous.

Secondly, compounds represented by formula (II) are illustrated. In formula (II), Q represents non-metal atoms constituting an unsubstituted or substituted 5-membered ring.

Examples of a 5-membered ring containing Q as its constituent include an imidazole ring, a 2-imidazoline ring, a 1H-1,2,4-triazole ring, a 1H-1,2,3-triazole ring, a 2H-1,2,3-triazole ring, a 4H-1,2,4-triazole ring, a tetrazole ring, a thiadiazole ring, an oxadiazole ring and a selenadiazole ring. These rings each may have a substituent or substituents. Of these rings, an imidazole ring, a 2-imidazoline ring and each of triazole rings are preferred over the others.

As examples of substituents the rings as recited above can have, mention may be made of 1–8C alkyl groups, 2–8C alkenyl groups, 1–8C alkoxy groups, 6–8C aryl groups, 7–8C aralkyl groups, 1–8C allyl groups, a hydroxyl group, a carboxyl group, a sulfo group and a moiety forming a benzene ring by fusing with a 5-membered ring as recited above. These substituents each may further be substituted with a methoxy group, an ethoxy group, a hydroxyl group, a carboxyl group and/or a sulfo group. Further, the substituents at the 4- and 5-positions may combine with each other to form a ring.

Of the substituents recited above, those preferred in particular include 1–3C alkyl groups, 2–3C alkenyl groups, 1–3C alkoxy groups, 3–5C allyl groups, a hydroxyl group, a carboxyl group, a sulfo group, a phenyl group, 3–4C alkylene groups which each form an alicyclic ring by fusing with a 5-membered ring containing Q as its constituent at the 4- and 5-positions, and groups formed by substitution of hydroxyl, carboxyl or sulfo groups for hydrogen atoms of the hydrocarbon groups recited above as preferred ones.

Examples of a compound represented by formula (II) are illustrated below, but these examples should not be construed as limiting the scope of compounds usable in the invention.

(II-1) Imidazole
(II-2) 2-Methylimidazole
(II-3) 1-Methylimidazole
(II-4) 2,4-Dimethylimidazole
(II-5) 4,5-Dimethylimidazole
(II-6) 4-Phenylimidazole
(II-7) 2-Carboxymethylimidazole
(II-8) 1-Carboxymethylimidazole
(II-9) 1-Hydroxymethylimidazole
(II-10) 4-Hydroxyimidazole
(II-11) 2-Imidazoline
(II-12) 4,5-Dimethyl-2-imidazoline
(II-13) 4-Carboxy-2-imidazoline
(II-14) 4-Hydroxy-2-imidazoline
(II-15) 4-Hydroxymethyl-2-imidazoline
(II-16) 1H-1,2,4-triazole
(II-17) 1-Methyl-1,2,4-triazole
(II-18) 1H-3-methyl-1,2,4-triazole
(II-19) 1H-5-methoxy-1,2,4-triazole
(II-20) 1H-5-sulfoethyl-1,2,4-triazole (II-21) 1H-3-hydroxymethyl-1,2,4-triazole
(II-22) 1H-3-carboxy-1,2,4-trizole
(II-23) 1H-4-sulfo-1,2,3-triazole
(II-24) 1H-4-hydroxymethyl-1,2,3-triazole
(II-25) 1H-4-methyl-1,2,3-triazole
(II-26) 2H-1,2,3-triazole
(II-27) 4H-1,2,4-triazole
(II-28) 5-Methoxytetrazole
(II-29) Tetrazole-5-carboxylic acid
(II-30) Tetrazole-5-sulfonic acid Each of the acid group-containing compounds recited above can take the form of an alkali metal salt or an onium salt.

Of those compounds, imidazole, 2-methylimidazole, 1-methylimidazole, 2-carboxymethylimidazole, 1-carboxymethylimidazole, 4-hydroxyimidazole, 2-imidazoline, 4-carboxy-2-imidazoline, 4-hydroxy-2-imidazoline, 4-hydroxymethyl-2-imidazoline, 1H-1,2,4-triazole, 1-methyl-1,2,4-triazole, 1H-5-sulfoethyl-1,2,4-triazole and 1H-3-hydroxymethyl-1,2,4-triazole are preferred over the others.

These compounds can be synthesized in accordance with literature on the synthesis methods, and they are commercially available, too.

The concentration of a compound of formula (I) in the rinsing solution is usually from 0.05 to 5.0 g/L, preferably from 0.1 to 1.0 g/L, particularly preferably from 0.2 to 0.5 g/L. And the concentration of a compound of formula (II) in the rinsing solution is from 0.05 to 2.0 g/L, preferably from 0.1 to 1.5 g/L, particularly preferably from 0.5 to 1.5 g/L.

The concentrations of compounds represented by formulae (I) and (II) in a prepared chemical for rinse processing are adjusted individually so as to fall within the aforementioned concentration ranges when the intended rinsing solution is prepared from the prepared chemical. When the prepared chemical is a concentrated liquid processing chemical, it is generally diluted with 10 to 200 parts of water and used as a rinsing solution. Therefore, the concentration of a compound represented by formula (I) is from 5.0 to 100 g/L, preferably from 10 to 50 g/L, and that of a compound represented by formula (II) is from 5 to 200 g/L, preferably from 10 to 150 g/L.

The suitable pH of the rinsing solution is from 3 to 10, preferably from 5 to 8.5. The temperature at which the rise processing is carried out, though can be determined variously depending on the use and characteristics of photosensitive materials to be processed, is generally from 25° C. to 60° C., preferably from 30° C. to 50° C.

To the rinsing solution, the method of reducing calcium and magnesium ions as disclosed in Japanese Patent Laid-Open No. 288838/1987 can be applied very effectively. In addition, it is possible to use in the rinsing solution the isothiazolone compounds and thiabendazoles disclosed in Japanese Patent Laid-Open No. 8542/1982, the chlorine-containing bactericides, such as sodium salt of chlorinated isocyanuric acid disclosed in Japanese Patent Laid-Open No. 120145/1986, the benzotriazoles disclosed in Japanese Patent Laid-Open No. 267761/1986, copper ion, and other bactericides as described in Hiroshi Horiguchi, *Bohkin Bohbai no Kagaku* (which means "Antibacterial and Mold-proof Chemistry"), Sankyo Shuppan (1985); *Biseibutsu no Mekkin Sakkin Bohbai Gijutsu* (which means "Arts of Sterilizing and Pasteurizing Microbes, and Proofing Against Molds"), compiled by Eisei Gijutsukai, published by Kogyo Gijutsu Kai in 1982; and Bohkin-Bohbaizai Jiten (which means "Thesaurus of Anti-bacteria and Anti-molds"), compiled by Nippon Bohkin Bohbai Gakkai.

In addition to the compounds of formula (I), surfactants other than the compounds of formula (I), EDTA as water softening agent, and chelating agents represented ethylenediamine-disuccinic acid can be used as agents for draining water off.

The composition of the rinsing solution used in the invention is mentioned above, and further description of the rinsing solution, including a replenishment rate, is made hereinafter in the sections "Processing process usable in the invention" and "Processors to which the invention is applicable".

Processing solutions usable in the present color development-processing method, other than the rinsing solution, are illustrated below.

The color developing solution contains a color developing agent. Preferred color developing agents are known aromatic primary amine color developing agents, especially p-phenylenediamine derivatives, and the representatives thereof are recited below. However, these examples should not be construed as limiting the scope of color developing agents usable in the invention.

1) N,N-diethyl-p-phenylenediamine
2) 4-Amino-3-methyl-N,N-diethylaniline
3) 4-Amino-N-(β-hydroxyethyl)-N-methylaniline
4) 4-Amino-N-ethyl-N-(β-hydroxyethyl)aniline
5) 4-Amino-3-methyl-N-ethyl-N-(β-hydroxyethyl)aniline
6) 4-Amino-3-methyl-N-ethyl-N-(3-hydroxypropyl)aniline
7) 4-Amino-3-methyl-N-ethyl-N-(4-hydroxybutyl)aniline
8) 4-Amino-3-methyl-N-ethyl-N-(β-methanesulfonamidoethyl)-ani line
9) 4-Amino-N,N-diethyl-3-(β-hydroxyethyl)aniline
10) 4-Amino-3-methyl-N-ethyl-N-(β-methoxyethyl)aniline
11) 4-Amino-3-methyl-N-(β-ethoxyethyl)-N-ethylaniline
12) 4-Amino-3-methyl-N-(3-carbamoylpropyl-N-n-propyl)-aniline
13) 4-Amino-N-(4-carbamoylbutyl-N-n-propyl-3-methyl) aniline
15) N-(4-amino-3-methylphenyl)-3-hydroxypyrrolidine
16) N-(4-amino-3-methylphenyl)-3-(hydroxymethyl)pyrrolidine
17) N-(4-amino-3-methylphenyl)-3-pyrrolidine carboxamide Of the p-phenylenediamine derivatives recited above, Compounds 5), 6), 7), 8) and 12) are preferred over the others. In particular, Compounds 5) and 8) are advantageous. These p-phenylenediamine derivatives generally take the form of a salt, such as sulfate, hydrochloride, sulfite, naphthalenesulfonate or p-toluenesulfonate, when they are in a solid state.

As to the content of an aromatic primary amine developing agent in a processing solution, the developing agent is added to a prepared solution in such a concentration as to make its amount per liter of developer fall within the range of 2 to 200 millimoles, preferably 6 to 100 millimoles, particularly preferably 10 to 40 millimoles.

Depending on the type of photosensitive materials to be developed, there are cases where the color developer contains a small amount of sulfite ion, or in other cases, substantially no sulfite ion is contained in the color developer. In the invention, however, it is preferable to add a small amount of sulfite ion to the color developer. The sulfite ion has remarkable preservative action, but there may be cases where the sulfite ion present in excessive amounts exerts undesirable influences on photographic properties at the step of color development.

In addition, the color developer may contain a small amount of hydroxylamine. When the hydroxylamine (which is generally used in the form of hydrochloride or sulfate, but the salt form is omitted hereinafter) is contained, it functions as a preservative of the developer as with the sulfite ion. As the hydroxylamine is apt to exert undesirable influences on photographic characteristics because of its own silver-development activity, the addition amount thereof is required to be small.

To the color developer, organic preservatives may be added as well as the aforementioned hydroxylamine and sulfite ion. The term "organic preservatives" as used herein refers to all of the organic compounds capable of reducing a deterioration speed of an aromatic primary amine color developing agent when incorporated in the solution for processing photosensitive materials. Specifically, they are organic compounds having the function of preventing air oxidation of the color developing agent. Especially effective organic preservatives include not only the hydroxylamine derivatives as recited above but also hydroxamic acids, hydrazides, phenols, α-hydroxyketones, α-aminoketones, sugars, monoamines, diamines, polyamines, quaternary ammonium salts, nitroxy radicals, alcohols, oximes, diamide compounds and condensed-ring amines. These organic preservatives are disclosed in Japanese Patent Laid-Open Nos. 4235/1988, 30845/1988, 21647/1988, 44655/1988, 53551/988, 43140/1988, 56654/1988, 58346/988, 43138/1988, 146041/1988, 44657/988 and 44656/1988, U.S. Pat. Nos. 3,615,503 and 2,494,903, Japanese Patent Laid-Open No. 143030, and Japanese Patent Publication No. 48/30496.

As other preservatives, the various metals disclosed in Japanese Patent Laid-Open Nos. 44148/1982 and 53749/1982, the salicylic acids disclosed in Japanese Patent Laid-Open No. 180588/1982, the alkanolamines disclosed in Japanese Patent Laid-Open No. 3532/1979, the polyethyleneimines disclosed in Japanese Patent Laid-Open No. 94349/1981 and the aromatic polyhydroxy compounds disclosed in U.S. Pat. No. 3,746,544 may be added, if desired. In particular, alkanolamines, such as triethanolamine and triisopropanolamine, substituted or unsubstituted dialkylhydroxylamines, such as disulfoethylhydroxylamine and diethylhydroxylamine, or aromatic polyhydroxy compounds may be added.

Details of the hydroxylamine derivatives as organic preservatives are described in Japanese Patent Laid-Open Nos. 97953/1989, 186939/1989, 186940/1989 and 087558/1989. From the viewpoint of enhancing stability of a color developer and consistency during the continuous processing, it may be especially effective to add hydroxylamine derivatives and amines in combination.

As examples of such amines, mention may be made of the cyclic amines as disclosed in Japanese Patent Laid-Open No. 239447/1988, the amines as disclosed in Japanese Patent Laid-Open No. 138340/1988, and the amines as disclosed in Japanese Patent Laid-Open Nos. 186939/1989 and 187557/1989. The appropriate proportion of preservatives to the processing chemicals used depends on the species of the preservatives. In general, the preservatives are added to a prepared solution in such a concentration as to make their amount per liter of developer fall within the range of 1 to 200 millimoles, preferably from 10 to 100 millimoles.

To a color developer, such as a developer for color paper, chloride ion can be added, if needed. In many of usual cases, the chloride ion concentrations in color developers (especially developers for color print materials) are within the range of $3.5\times10^{-2}$ to $1.5\times10^{-1}$ mole/liter. However, there are also many cases where the addition of chloride ion to a developing agent for replenishment is unnecessary, because chloride ion is generally released into the developer as a by-product of development. In the case of developing agents used for photosensitive materials of picture-taking type, chloride ion may not be added.

As to the bromide ion, it is appropriate that the bromide ion concentration in a color developer be of the order of $1–5\times10^{-3}$ mole/liter in the case of processing photosensitive materials of picture-taking type, while it is not greater than $1.0\times10^{-3}$ mole/liter in the case of processing print materials. However, as with chloride ion, the addition of bromide ion to a color developer is unnecessary in many cases. In the case where the addition of bromide ion is required, however, bromide ion may be added to a processing chemical so that the bromide ion concentration falls within the aforementioned range.

In the cases where iodobromide emulsions constitute the photosensitive materials to be processed, such as the cases of color negative films and color reversal films, the appropriate concentration of iodide ion is in the same situation as those of chloride and bromide ions. In general, the iodide ion concentration becomes 0.5 to 10 mg/liter of developer as a result of iodide ion release from photo sensitive materials. Therefore, it is usual that no iodide ion is added to processing chemicals for replenishment.

In the cases of using halides as additive ingredients in developers or/and development replenishers, materials usable for providing chloride ions include sodium chloride, potassium chloride, ammonium chloride, lithium chloride, nickel chloride, magnesium chloride, manganese chloride and calcium chloride. Of these chlorides, sodium chloride and potassium chloride are used advantageously.

Examples of materials usable for providing bromide ions include sodium bromide, potassium bromide, ammonium bromide, lithium bromide, calcium bromide, magnesium bromide, manganese bromide, nickel bromide, cerium bromide and thallium bromide. Of these bromides, potassium bromide and sodium bromide are preferred over the others.

As a material for providing iodide ion, sodium iodide or potassium iodide is used.

In the invention, it is appropriate that the developer and the replenisher be both adjusted to pH 9.0–13.5. Therefore, alkali agents, pH buffers and, if needed, acid agents can be added to each of the developer and the replenisher in amounts required for keeping the pH values of these processing solutions within the foregoing range.

In order to let each processing solution have its pH within the range specified above at the time when it is prepared, it is preferable to use various kinds of buffering agents. The buffering agents usable herein include carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts and lycine salts. In particular, phosphates, tetraborates and hydroxybenzoates are preferred as buffering agents over the other salts. This is because these salts possess advantages that they have excellent buffering capability in the high pH range of 9.0 or above, exert no bad influences (e.g., fogging) on photographic properties when added to color developers, and are inexpensive.

Examples of these buffering agents include sodium carbonate, potassium carbonate, sodium hydrogen carbonate, pottasium hydrogen carbonate, trisodium phosphate, tripotassium phosphate, disodium hydrogen phosphate, dipotassium hydrogen phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate). However, the buffering agents usable in the invention should not be construed as being limited to these compounds.

As the buffering agents are not ingredients of the type which are consumed by undergoing reaction, they are added to a developing composition in an amount that their concentrations in the developer and the replenisher prepared from processing chemicals are both within the range of 0.01 to 2 moles per liter, preferably 0.1 to 0.5 mole per liter.

To a color developer can be added various chelating agents having the function of inhibiting precipitation of other ingredients of the color developer, such as calcium and magnesium, or the function of enhancing the color developer stability. As examples of such chelating agents, mention may be made of nitrilotriacetic acid, diethylenetriaminepenta-acetic acid, ethylenediaminetetraacetic acid, N,N,.N-trimethylenephoshonic acid, ethylenediamine-N,N,N'-tetramethylenesulfonic acid, trans-cyclohexanediaminetetra-acetic acid, 1,2-diaminopropanetetraacetic acid, glycoletherdiaminetetraacetic acid, ethylenediamine-o-hydroxyphenylacetic acid, ethylenediaminesuccinic acid (SS body), N-(2-carboxylatoethyl)-L-aspartic acid, β-alaninediacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid, and 1,2-dihydroxybenzene-4,6-disulfonic acid.

Two or more of these chelating agents may be used in combination.

It may be good to add these chelating agents in an amount enough to block metal ions in a color developer prepared. For instance, they are added in an amount to ensure the concentration of the order of 0.1–10 g per liter.

To the color developer used in the invention, any development accelerator already known maybe added, if desired. For instance, the thioether compounds as disclosed in Japanese Patent Laid-Open Nos. 16088/1962, 5987/1962, 7826/1962, 12380/1969 and 9019/1970, and U.S. Pat. No. 3,813,247, the p-phenylenediamine compounds as disclosed in Japanese Patent Laid-Open Nos. 49829/1977 and 15554/1975, the quaternary ammonium salts as disclosed in Japanese Patent Laid-Open Nos. 137726/1975, 30074/1969, 156826/1981 and 43429/1977, the amine compounds as disclosed in U.S. Pat. Nos. 2,494,903, 3,128,182, 4,230,796 and 3,253,919, Japanese Patent Laid-Open No. 11431/1966, and U.S. Pat. Nos. 2,482,546, 2,596,926 and 3,582,346, the polyalkylene oxides as described in Japanese Patent Laid-Open Nos. 16088/1962 and 25201/1967, U.S. Pat. No. 3,128,183, Japanese Patent Laid-Open Nos. 11431/1966 and 23883/1967, and U.S. Pat. No. 3,532,501, 1-phenyl-3-pyrazolidones and imidazoles can be added as development accelerators, if needed. The amounts of these development accelerators added to compositions are determined so that the development accelerator concentration in each of the developer and the replenisher prepared from processing chemicals is in the range of 0.001 to 0.2 mole/liter, preferably 0.01 to 0.05 mole/liter.

To the color developer used in the invention, any antifoggant already known, other than halide ions as described above, can be added, if needed. As typical examples of an organic antifoggant which can be used, mention may be made of nitrogen-containing heterocyclic compounds including benzotriazole, 6-nitrobenzimidazole, 5-nitroisoindazole, 5-methylbenzotriazole, 5-nitrobenzotriazole, 5-chloro-benzotriazole, 2-thiazolylbenzimidazole, 2-thiazolylmethyl-benzimidazole, indazole, hydroxyazaindolizine and adenine.

Further, various surfactants, such as alkylsulfonic acids, arylsulfonic acids, aliphatic carboxylic acids and aromatic carboxylic acids, may be added to the color developer used in the invention, if desired.

The amounts of surfactants added to compositions are determined so that the surfactant concentration in each of the developer and the replenisher prepared from processing chemicals is in the range of 0.0001 to 0.2 mole/liter, preferably 0.001 to 0.05 mole/liter.

In the invention, brightening agents can be used as required. The brightening agents suitably used in the invention are bis(triazinylamino)stilbenesulfonic acid compounds. As the bis(triazinylamino)stilbenesulfonic acid compounds, known or commercially available diaminostilbene family of brightening agents can be used. Of the known bis(triazinylamino)stilbenesulfonic acid compounds, the compounds as disclosed in Japanese Patent Laid-Open Nos. 329936/1994, 140625/1995 and 140849/1998 are preferred. Examples of commercially available compounds are described, e.g., in *Senshokunotes* (which means "Dyeing Notes", 9th edition, pp. 165–168, Shikisen-Sha. Of the compounds recited in such a book, Blankophor BSU liq. and Hakkol BRK are preferred over the others.

Then, processing solutions used at a desilvering step are explained. Firstly, beaching agents used for bleaching and bleach-fix solutions in color photographic processing are described.

Although known bleaching agents are usable in the bleaching solution and the bleach-fix solution, especially suitable bleaching agents include organic complex salts of Fe(III) (e.g., Fe(III) complex salts of aminopolycarboxylic acids), organic acids such as citric acid, tartaric acid and malic acid, persulfates and hydrogen peroxide.

Of these bleaching agents, organic complex salts of Fe(III) are preferred in particular from the viewpoints of rapid processing and prevention of environmental pollution. Examples of aminopolycarboxylic acids useful for forming organic complex salts of Fe(III) and salts thereof include not only biodegradable aminopolycarboxylic acids, such as ethylenediaminedisuccinic acid (SS body), N-(2-caboxylatoethyl)-L-aspartic acid, β-alaninediacetic acid and methyliminodiacetic acid, but also ethylenediaminetetraacetic acid, diethylenetriaminepentaacetic acid, 1,3-diaminopropanetetraacetic acid, propylenediaminetetraacetic acid and nitrilotriacetic acid. The salts formed from these acids may be any of sodium, potassium, lithium and ammonium salts. Of these acids, ethylenediaminesuccinic acid (SS body), N-(2-carboxyethyl)-L-aspartic acid, β-alaninediacetic acid, ethylenediaminetetraacetic acid, 1,3-diaminopropanetetra-acetic acid and methyliminodiacetic acid are preferred over the others because their Fe(III) complex salts can ensure good photographic properties. These complex salts of ferric ion may be used in the complex salt form, or they may be formed in a solution by use of ferric salts, such as ferric sulfate, ferric chloride, ferric nitrate, ammonium ferric sulfate and ferric phosphate, and chelating agents such as aminopolycarboxylic acids. Further, the chelating agents may be added in excess of an amount required for forming ferric ion complex salts. Of iron complex salts, aminopolycarboxylic acid-iron complex salts are preferred over the others.

The addition amount of a bleaching agent is determined so that the prepared processing solution has a bleaching agent concentration of 0.01 to 1.0 mole/liter, preferably 0.03 to 0.80 mole/liter, far preferably 0.05 to 0.70 mole/liter, particularly preferably 0.07 to 0.50 mole/liter.

It is appropriate for the bleaching solution, the bleach-fix solution or a fixer to contain a wide variety of known organic acids (e.g., glycolic acid, succinic acid, maleic acid, malonic acid, citric acid, sulfosuccinic acid), organic bases (e.g., imidazole, dimethylimidazole), the compounds represented by formula (A-a) disclosed in Japanese Patent Laid-Open No. 211819/1997, including 2-picolinic acid, and the compounds represented by formula (B-b) disclosed in the same gazette, including kojic acid. The suitable addition amount of such a compound is determined so that the prepared processing solution has a compound concentration of 0.005 to 3.0 mole/liter, preferably 0.05 to 1.5 mole/liter.

Next, fixing agents (including fixing agents of a bleach-fix solution for color photography) are explained collectively. The compounds used in a bleach-fix solution or as fixing agent are known fixing chemicals, namely water-soluble silver halide solvents, such as thiosulfates including sodium thiosulfate and ammonium thiosulfate, thiocyanates including sodium thiocyanate and ammonium thiocyanate, thioether compounds including ethylenebisthioglycolic acid and 3,6-dithia-1,8-octanediol, and thioureas. These compounds can be used alone or as mixtures of two or more thereof. On the other hand, a special bleach-fix solution containing a combination of the fixing agent as disclosed in Japanese Patent Laid-Open No. 155354/1980 and a large amount of halide, such as potassium iodide, can be employed. In the invention, the use of thiosulfates, especially ammonium thiosulfate is advantageous. The suitable concentration of fixing chemicals in each of fixing and bleach-fix solutions prepared from granular processing agents is from 0.3 to 3 moles, preferably 0.5 to 2.0 moles, per liter of prepared solution.

The suitable pH range of each of the present bleach-fix and fixing solutions at the time of dissolution is from 3 to 8, preferably from 4 to 8. When the pH is lower than the foregoing range, the desilvering capability is increased, but deterioration of the solutions and conversion of cyan dyes into leuco compounds thereof are accelerated. When the pH is higher than the foregoing range, on the other hand, the desilvering is retarded and stains are liable to develop.

For the pH adjustment, the solid-state acids as recited above, the solid-state alkalis as recited above, such as potassium hydroxide, sodium hydroxide, lithium hydroxide, lithium carbonate, sodium carbonate and potassium carbonate, and acidic or alkaline buffers can be added.

The bleach-fix solution can further contain various other additives, such as a brightening agent, an antifoaming agent or a surfactant, and polyvinyl pyrrolidone. Additionally, it is also permitted to incorporate the brightening agent in the developing solution prepared into a color developer so as to have a concentration of 0.02 to 1.0 mole/liter.

It is appropriate for the bleach-fix solution and the fixing solution to contain as preservatives sulfite ion-releasing compounds, such as sulfites (e.g., sodium sulfite, potassium sulfite, ammonium sulfite), hydrogen sulfites (e.g., ammonium hydrogen sulfite, sodium hydrogen sulfite, potassium hydrogen sulfite) and metabisulfites (e.g., potassium metabisulfite, sodium metabisulfite, ammonium metabisulfite), and arylsulfinic acids, such as p-toluenesulfinic acid and m-carboxybenzenesulfinic acid. The suitable concentration of these compounds are from about 0.02 to about 1.0 mole/liter, based on sulfite ions or sulfinate ions.

In addition to the preservatives as recited above, ascorbic acid, carbonyl-hydrogen sulfite adducts or carbonyl compounds may be added as preservatives.

After the conclusion of fixation or bleach-fixation, processing with a rinsing bath (or a stabilizing bath as a washing substitute) or a stabilizing bath for image stabilization is performed. This processing is already described.

Up to this point we have described the ingredients constituting processing solutions used in photographic processing to which the invention is applied.

Next the processing steps using the present processing solutions are explained.

The photographic processing to which the invention is applicable includes a color development step, a desilvering step, a washing step or a step of using a stabilizing bath, and a drying step. Further, an auxiliary step, such as a rinsing step, an intermediate washing step or a neutralizing step, may also be inserted in each individual interval between two successive steps. The desilvering processing is effected by one-step processing with a bleach-fix solution or two-step processing constituted of a bleach processing and a fixation processing. In addition to the step with a stabilizing bath as a washing step substitute, a step with an image stabilization bath can be inserted between the washing or stabilizing step as a washing substitute and the drying step.

The processing method adopted in the invention may be any of processing methods of rapid development type, low replenishment rate type and internationally compatible standard type.

When the photosensitive materials to undergo development-processing are color picture-taking materials, such as color negative and color reversal films, the processing temperature is from 30° C. to 40° C. in general cases, while in the rapid-processing cases the processing temperature is in the range of 38 to 65° C., preferably 40 to 55° C. The development-processing time is from 1 to 8 minutes in general cases, while in the rapid-processing cases the processing time is in the range of 15 to 195 seconds, preferably 20 to 150 seconds. The replenishment rate is 600 milliliter per $m^2$ of photosensitive material in the standard development, while in the processing at a low replenishment rate the replenishment volume per $m^2$ of photosensitive material is from 30 to 390 milliliter, preferably from 50 to 300 milliliter, particularly preferably from 80 to 200 milliliter.

When the photosensitive materials to undergo development-processing are color print materials such as color photographic paper, the processing temperature is from 30° C. to 40° C. in general cases, while in the rapid-processing cases the processing temperature is in the range of 38 to 65° C. The development-processing time is from 30 seconds to 3 minutes in general cases, while in the rapid-processing cases the processing time is in the range of 5 to 45 seconds, preferably 5 to 20 seconds. The replenishment rate is 161 milliliter per $m^2$ of photosensitive material in the standard development, while in the processing at a low replenishment rate the replenishment volume per $m^2$ of photosensitive material is from 10 to 1500 milliliter, preferably from 20 to 100 milliliter, and in certain cases the replenishment volume may be in the range of 25 to 80 milliliter.

In the color photographic processing, photosensitive materials are subjected to the desilvering step subsequently to the development-processing step, and processed with both bleaching and fixing solutions, or with a bleach-fix solution.

The bleach time is generally from 10 seconds to 6 minutes and 30 seconds, preferably from 10 seconds to 4 minutes and 30 seconds, particularly preferably from 15 seconds to 2 minutes.

The fixation time is generally from 10 seconds to 6 minutes and 30 seconds, preferably from 10 seconds to 4 minutes and 30 seconds, particularly preferably from 15 seconds to 2 minutes. The present processing is especially suitable for the rapid processing cases in which the fixation is performed within 90 seconds, particularly within a period of 30 to 80 seconds.

The processing time at the bleach-fix processing step is from 5 to 240 seconds, preferably from 10 to 60 seconds.

The processing temperatures at those desilvering steps are in the range of 25° C. to 60° C., preferably 30° C. to 50° C. The replenishment rate at each of the steps is generally from 10 ml to 250 ml, preferably from 10 ml to 100 ml, particularly preferably from 15 ml to 60 ml, per $m^2$ of photosensitive material. In the case where the processing solutions are recycled, the replenishment rates thereof can be arbitrarily chosen from the range of from the aforementioned rates to reduced replenishment rates depending on whether or not the silver recovery step is introduced and what method is adopted for mixing with freshly prepared solutions.

From the viewpoint of processing solution stability, the replenishment rate of a rinsing solution in the present processing is not more than 850 ml, preferably from 200 to 800 ml, particularly preferably from 200 to 500 ml, per $m^2$ of photosensitive material.

The replenishment rate at the rinsing step can be selected from a wide range depending on the characteristics (e.g., properties of constituents used, including couplers) and uses of photosensitive materials to undergo the processing, the processing temperature, the number of tanks in the rinsing bath used (the number of stages) and various other conditions. The relations between these factors are similar to the relation between the number of washing tanks and the water volume in the multi-stage counter-current system, and can be determined by the method described in *Journal of the Society of Motion Picture and Television Engineers,* vol. 64, pp. 248–253 (May, 1955). The suitable number of stages in the multi-stage counter current system is generally from 3 to 15, preferably 3 to 10.

The appropriate time spent at the rinsing step in the present processing is not longer than 75 seconds, preferably 65 seconds or below. When the photosensitive materials to be processed are color negative films for general-purpose use, the processing for a short duration down to at least 50 seconds can be carried out. In the cases of other color photosensitive materials also, the rinsing time can be reduced to almost the same extent as in the cases of color negative films. The present rinse-processing composition has another advantage in that, even when photosensitive materials have undergone rinsing of such a short duration, the present composition used therein enables the photosensitive materials processed to maintain or enhance their physical film properties and image fastness and can ensure storage stability for the photosensitive materials processed.

The processing temperature at the rinsing step is from 25° C. to 60° C., preferably from 30° C. to 50° C. The present rinsing solution has still another advantage in that, even when it is used at high temperatures, the present rinsing solution can prevent coating layers from coming loose (or being soften), so the photosensitive materials processed can be dried rapidly at high temperatures.

According to the multi-stage counter current system, the replenishment rate of a rinsing solution can be reduced substantially, but the residence time of the rinsing solution in tanks is increased. As a result, suspended solids produced by propagation of bacteria cause a problem of adhering to photosensitive materials. As a solution to this problem, addition of anti-bacterial and mold-proof agents as recited herein before to the rinsing solution is preferred. Especially effective mold-proof agents are dichloroisocyanuric acid, 1,2-benzoisothiazoline-3-one and isothiazolone, and 1-(2,4-dichlorophenyl)-2-(2-propenyloxy)ethyl-1H-imidazole. The suitable concentration of such a mold-proof agent is from 0.005 to 0.1 g per liter of rinsing solution.

The number of processing tank(s) of a rinsing bath installed in the present processing apparatus, though it may be one, can be increased up to the order of 2–10. The replenishment rate at the rinsing step can be decreased with an increase in number of the tanks. When it is considered to make an automatic processor compact, the appropriate number of processing tanks is of the order of 2 to 6. The replenisher may be added to separate several tanks. However, it is preferable to adopt a counter current system (multi-stage counter current system), namely a system that the replenisher is added to a tank situated as downstream as possible, viewed from the flow of photosensitive materials, and an overflow solution from the tank (including the case of passing a solution through a tube which is placed beneath the surface of solution and connects two adjacent tanks) is made to flow into the adjacent tank situated upstream. A cascade flow system also is included in such a counter current system. Far preferably, the rinsing tank at the tail end of a train of tanks is replenished with a rinsing solution and an overflow therefrom continue to be brought and poured into tanks arranged forward in sequence.

From the viewpoints of reduction in the total amount of wastes and betterment of image keeping quality of the processed photosensitive materials, it is also beneficial that all or part of the rinsing solution pumped out of a rinsing tank is brought into a processing tank used at the immediately preceding step, usually a fixing tank.

Subsequently to the rinsing step, drying is carried out. From the viewpoint of reduction in quantity of water brought in the image-formed layers, it is also possible to absorb the water brought in by use of squeegee rollers or cloth and thereby to expedite the drying step. For improvement in drying efficiency on the side of a dryer, as a matter of course, it is possible to increase a drying speed by raising a drying temperature or modifying the shape of blowing nozzles to increase the blowing strength of a drying air. Further, as disclosed in Japanese Patent Laid-Open No. 157650/1991, the drying speed can be increased by making an adjustment to the blowing angle of drying air with respect to photosensitive materials and devising a removal method of drying-air emission.

Up to this point we have described the photographic processing method using the present granular processing agents. Next the processing apparatus performing the present photographic processing is explained.

The photographic processing method relating to the invention is carried out by use of an automatic processor. The automatic processor preferably used in the invention is described below.

It is appropriate in the invention that the linear speed of conveyance in the automatic processor be 100 mm/sec or below, preferably from 20 mm/sec to 50 mm/sec, particularly preferably from 25 to 45 mm/sec.

When the processing solutions relating to the invention are in a state that they are placed in processing tanks or replenisher tanks, it is advantageous for them to have the smallest possible contacted areas with air (opening area). For instance, taking the value obtained by dividing the opening area by the volume ($cm^3$) of a processing solution placed in a tank as an opening rate, the appropriate opening rate is 0.01 ($cm^{-1}$) or below, preferably 0.005 or below, particularly preferably 0.001 or below.

In order to reduce the contacted area with air, it is preferable to float a solid or liquid means for avoiding contact with air on the surface of a solution placed in a processing tank or a replenisher tank.

Specifically, it is preferable to float a plastic-made float on the surface of a solution or cover the surface of a solution with a liquid having no compatibility and causing no chemical reaction. Suitable examples of such a liquid include liquid paraffin and liquid saturated hydrocarbons.

For conveyance of leaders and photosensitive materials, it is preferable to adopt the belt conveyance systems disclosed in Japanese Patent Laid-Open Nos. 191257/1985, 191258/1985 and 191259/1985. Further, the structure of a crossover rack equipped with anti-mixing plates is favorable for reduction of a crossover time and prevention of mixing with processing solutions.

The conditions for drying photosensitive materials have influences also on vaporization of processing solutions. As a drying method, it is preferable to use a ceramic warm-air heater. The suitable quantity of air supplied is from 4 to 20 $m^3$ per minute, preferably from 6 to 10 $m^3$ per minute.

The operation of a thermostat for preventing the ceramic warm-air heater from overheating is preferably effected by thermal conduction. As to the position of the thermostat attached, it is appropriate to attach the thermostat upwind or downwind via heat dissipating fins or a heat-transfer section. The drying temperature is preferably adjusted depending on the water content in the photosensitive material processed. In general, the optimal drying temperature is from 45 to 55° C. in the case of APS-format films and 35 mm-wide films, while it is from 55 to 65° C. in the case of Blownie films. However, since the present invention enables high-temperature drying, time reduction can be achieved by rapid drying at high temperatures of 60 to 90° C. Preferably, the drying temperature is chosen from the range of 65 to 80° C.

At the time of replenishment of processing solutions, a replenishment pump, preferably a bellows replenishment pump, is used. For improving the replenishment accuracy, it is effective to design tubes for feeding a solution into replenishment nozzles so as to have small diameters and prevent a back-flow of the solution when the pump stops.

Figure 2:
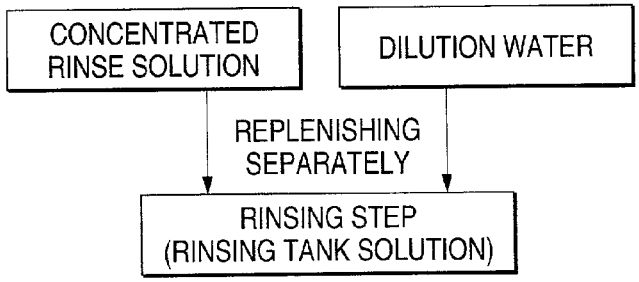
FIG. 2 is a diagram showing one embodiment of a mechanism of the invention for performing a replenishment of a rinsing solution.

The present rinse-processing composition has a property of not degrading the qualities of rubber- and organic synthetic resin-made valves and piping members of processing apparatus. Therefore, instead of a processing apparatus that has a mechanism preparing a rinsing replenisher by diluting a highly concentrated composition, storing it in a replenisher tank, and feeding the replenisher into a rinsing bath as shown in FIG. 1, it is feasible that a concentrated liquid rinsing chemical put in a vessel is loaded directly in the processing apparatus and the rinsing chemical is fed directly into a rinsing bath by means of a magnetic valve and a metering pump, as shown in FIG. 2.

Figure 3:
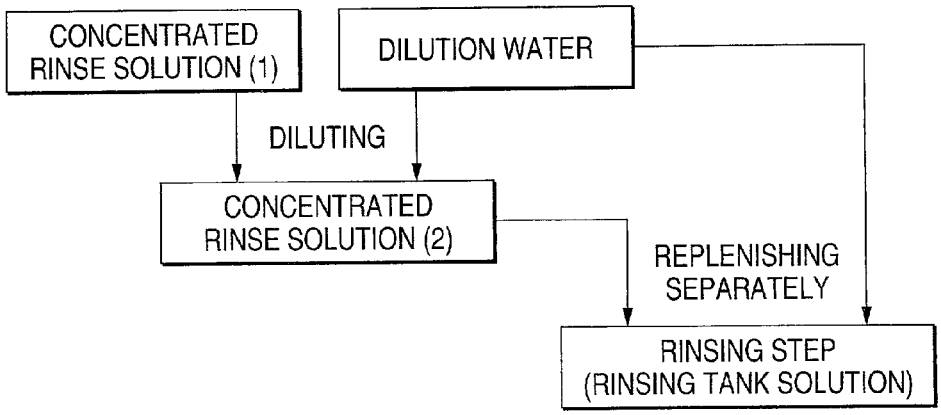
FIG. 3 is a diagram showing another embodiment of a mechanism of the invention for performing a replenishment a rinsing solution.

In order to further enhance the replenishment accuracy and utilize the water used for washing the vessel in which the concentrated liquid replenishing chemical has been stored, it is also permitted that a concentrated liquid replenishing chemical having a concentration higher than that of a replenisher is stored in a replenisher tank after slight dilution with water and then fed to a rinsing bath in a concentrated condition. In these cases where the rinsing bath is replenished using the concentrated liquid replenishing chemical in a concentrated condition without dilution or after slight dilution, the processing chemical concentration in the rinsing bath is controlled by supplying fresh water by another piping system or the water returned from the preceding step, as shown in FIG. 3.

Examples of processing apparatus to which the present rinsing composition supply system is applicable include the processing apparatus disclosed in Japanese Patent Laid-Open Nos. 287267/1991 and 110177/1994. In addition, as specific example of processing apparatus, an automatic processor FP-363SC made by Fuji Photo Film Co., Ltd. is exemplified, in which the rinse-processing composition of the present invention is used. However, the direct supply method of the present rinsing composition should not be construed as being limited to the aforementioned system.

The suitable drying time is from 5 seconds to 2 minutes, preferably 5 seconds to 70 seconds, particularly preferably from 30 seconds to 60 seconds.

Up to this point, the continuous processing according to the replenishment system is mainly described. However, it is also allowable to carry out the processing steps including development and subsequent steps by use of fixed amounts of processing solutions without addition of any replenishers, and thereafter replace all or part of the processing solutions by fresh ones and starting the processing again, in other words, to adopt a throw-away processing system.

Further, photosensitive materials to which the present processing agents can be applied are described.

The photosensitive materials used in the invention, as described above in relation to the aims and the background of the invention, include picture-taking color photographic materials, color paper and picture-taking black-and-white photographic materials, which prevail in the photo market. These photosensitive materials each have at least one light-sensitive layer on a support. A typical example of such materials is a silver halide photographic material having on a support at least one light-sensitive layer made up of a plurality of silver halide emulsion layers differing from one another in sensitivity but having substantially the same color sensitivity. The photosensitive materials on which the invention can produce especially great effects are color negative films.

In picture-taking multilayer silver halide color photographic materials, each of the light-sensitive layers is a unit light-sensitive layer having sensitivity to any of blue light, green light and red light. As to the arranging order of these unit light-sensitive layers from the support side, it is general to provide a red-sensitive layer, a green sensitive layer and a blue-sensitive layer in the order presented. Depending on the desired purpose, however, the unit light-sensitive layers may be arranged in inverse order, or it is permitted to take an arranging order such that a layer having certain color sensitivity is sandwiched between layers constituting a unit light-sensitive layer having color sensitivity different from that of the layer sandwiched. Further, light-insensitive layers may be provided between the silver halide light-sensitive layers, and the topmost and the lowest positions. In these layers, couplers as described below, DIR compounds and color mix inhibitors may be contained. As to the two or more silver halide emulsion layers constituting each unit light-sensitive layer, it is appropriate that a high-speed emulsion layer and a low-speed emulsion layer be arranged in decreasing order of sensitivity toward the support as disclosed in DE 1,121,470 and GB 923,945. On the other hand, as disclosed in Japanese Patent Laid-Open Nos. 112751/1982, 200350/1987, 206541/1987 and 206543/1987, it is allowable to arrange a low-speed emulsion layer on the side distant from the support and a high-speed emulsion layer on the side near the support.

For instance, from the side most distant from the support, a low-speed blue-sensitive layer (BL), a high-speed blue-sensitive layer (BH), a high-speed green-sensitive layer (GH), a low-speed green-sensitive layer (GL), a high-speed red-sensitive layer (RH) and a low-speed red-sensitive layer (RL) can be arranged in the order described. The arranging order may also be BH, BL, GL, GH, RH and RL, or it may be BH, BL, GH, GL, RL and RH, too.

Further, as disclosed in Japanese Patent Publication No. 34932/1980, the arrangement in the order of blue-sensitive layer/GH/RH/GL/RL from the side most distant from the support can be adopted. Furthermore, as disclosed in Japanese Patent Laid-Open Nos. 25738/1981 and 63936/1987, the arrangement in the order of blue-sensitive layer/GL/RL/GH/RH from the side most distant from the support can be adopted, too.

In addition, as disclosed in Japanese Patent Publication No. 15495/1974, it is permitted that three layers differing in sensitivity are arranged in the decreasing order of sensitivity towards a support. Specifically, the silver halide emulsion layer having the highest sensitivity is arranged as the upper layer, the silver halide emulsion layer having the sensitivity lower than that of the upper layer is arranged as the intermediate layer and the silver halide emulsion layer having the sensitivity lower than that of the intermediate layer is arranged as the lower layer. In the case where three layers arranged are different in sensitivity to light but the same in color sensitivity, as disclosed in Japanese Patent Laid-Open No. 202464/1984, the arrangement in the order of the medium-speed emulsion layer, the high-speed emulsion layer and the low-speed emulsion layer from the side distant from the support may also be adopted.

The arrangements in other orders, namely the order of high-speed emulsion layer/low-speed emulsion layer/medium-speed emulsion layer and the order of low-speed emulsion layer/medium-speed emulsion layer/high-speed emulsion layer, may be adopted. In the cases of arranging 4 or more layers differing in sensitivity to light, the order of arrangement may be varied as described above.

For improvement of color reproducibility, as disclosed in U.S. Pat. Nos. 4,663,271, 4,705,744 and 4,707,436, and Japanese Patent Laid-Open Nos. 160448/1987 and 89850/1988, it is favorable that donor layers (CL) having interlayer effects and differing in spectral sensitivity distribution from main light-sensitive layers, such as BL, GL and RL, are arranged in the positions adjacent to or in vicinity of the main light-sensitive layers.

Silver halide suitably used in picture-taking materials is silver iodobromide, iodochloride or iodochlorobromide having an iodide content of about 30 mole % or below. In particular, silver iodobromide or iodochlorobromide having an iodide content of from about 2 mole % to about 10 mole % is preferred.

The silver halide grains in photographic emulsions may be grains having a regular crystal shape, such as that of a cube, an octahedron or a tetradecahedron, or an irregular crystal shape, such as that of a sphere or a tablet, or grains having crystal defects, such as a twin plane, or grains having a composite crystal shape.

The grain size of silver halide may be in a wide range, because grains are formed so as to be suited for each individual light-sensitive layer. Specifically, any grains including fine grains having a projected area diameter of 0.1 to 0.2 μm and coarse grains having a projected area diameter of 1.0 to 10 μm may be used. Further, the emulsions used may be polydisperse or monodisperse emulsions.

In the color photosensitive materials, it is advantageous to use light-insensitive fine-grain silver halide. The light-insensitive fine-grain silver halide is defined as the fine grains of silver halide which are neither sensitized by imagewise exposure for forming dye images nor developed in a substantial sense at the development-processing step. It is preferable that these fine grains be not fogged in advance. The fine-grain silver halide has a bromide content of 0 to 100 mole %, and may contain chloride and/or iodide, if desired. Preferably, 0.5 to 10 mole % of idodide is contained therein. The suitable average diameter (mean value of diameters of circles having the areas equivalent to projected areas of grains) of fine grains is from 0.01 to 0.5 μm, preferably from 0.02 to 0.2 μm.

The fine-grain silver halide can be prepared in the same manner as general light-sensitive silver halide. It is not necessary for the silver halide grain surface to undergo optical sensitization and spectral sensitization. However, prior to adding them to a coating solution, it is appropriate that known stabilizers, such as triazole compounds, azaindene compounds, benzothiazolium compounds, mercapto compounds or zinc compounds, be added to the coating solution. In the layer containing those fine-grain silver halide, colloidal silver can be incorporated.

The suitable silver coverage of a color photosensitive material to which the present processing chemicals are applicable is 0.6 $g/m^2$ or below, preferably 4.5 $g/m^2$ or below.

In the color photosensitive material to which the present processing chemicals are applied, the suitable total layer thickness of all hydrophilic colloidal layers present on the emulsion layer side is 28 μm or below, preferably 23 μm or below, far preferably 18 μm or below, particularly preferably 16 μm or below. And the layer swelling speed $T_{1/2}$ is preferably 30 seconds or below, particularly preferably 20 seconds or below. The term $T_{1/2}$ is defined as the time required for the layer thickness to reach on-half the saturated layer thickness determined as 90% of the total thickness of layers swollen to the maximum when the layers are processed with a color developer at a temperature of 30° C. for a period of 3 minutes and 15 seconds. The term "layer thickness" as used herein means the layer thickness measured under a temperature of 25° C. and a relative humidity regulated at 55% (2 days). And the value of $T_{1/2}$ can be determined by use of a swellometer of the type described in A. Green et al., *Photogr. Sci. Eng.,* Vol. 19, No. 2, pp. 124–129. The value of $T_{1/2}$ can be adjusted by adding a hardener to gelatin used as a binder, or changing the aging condition after coating. The suitable rate of swelling is from 150 to 400%. The term "rate of swelling" is defined as total thickness of layers swollen to the maximum−layer thickness)/layer thickness, and can be calculated from the total thickness of layers swollen to the maximum under the foregoing condition.

On the other hand, the crystal shape of silver halide grains contained in photographic emulsions preferably used for making prints may be any of regular crystal shapes, such as those of a cube, a tetradecahedron or an octahedron, shapes having irregular crystal habits, such as a sphere and a tablet, and composites of these shapes.

As to the tabular grains, one pair of parallel surfaces perpendicular to the thickness direction is referred to as the major surfaces. In the invention, it is preferable to use photographic emulsions containing tabular grains having {111} or {100} faces as major surfaces.

With respect to the formation of {111} tabular grains, the methods using various crystal-phase controllers are disclosed. For instance, the compounds disclosed in Japanese Patent Laid-Open No. 32/1990 (Compound Examples 1 to 42) are used to advantage.

The grains having a silver chloride content higher than at least 80 mole % are referred to as high-chloride silver halide grains. Therein, it is appropriate that the chloride content be 95 mole % or more. It is preferable that the grains used in the invention have the so-called core/shell structure constituted of a core part and a shell part surrounding the core part. The suitable chloride content in the core part is at least 90 mole %. And the core part may be made up of two or more sections differing in halide composition. The suitable proportion of the shell part in each grain is not higher than 50%, especially not higher than 20%, of the total grain volume. The shell part is preferably silver iodochloride or silver iodobromochloride. The suitable iodide content in the shell part is from 0.5 mole % to 13 mole %, especially from 1 mole % to 13 mole %. And the suitable iodide content in the entire grain is not higher than 5 mole %, especially not higher than 1 mole %.

It is appropriate that the bromide content be higher in the shell part than in the core part. The suitable bromide content is not higher than 20 mole %, particularly not higher than 5 mole %.

Silver halide grains incorporated in photosensitive materials for photographic paper use have no particular restrictions as to their average grain size (sphere-equivalent diameter on a volume basis). However, the average grain sizes ranging from 0.1 μm to 0.8 μm, especially from 0.1 to 0.6 μm, are preferred. As to the tabular grains, it is appropriate that the circle-equivalent diameters thereof be in the range of 0.2 to 1.0 μm. The term "diameter of each individual silver halide grain" refers to as the diameter of a circle having the same area as the projected area of each individual grain on an electron micrograph. The grain thickness is not greater than 0.2 μm, preferably 0.15 μm or below, particularly preferably 0.12 μm or below. The grain size distribution of silver halide grains may be polydisperse or monodisperse, but it is advantageous that the silver halide grains have a monodisperse size distribution. In particular, it is preferred that the tabular grains constituting at least 50% of the total grains on a projected area basis have a variation coefficient of 20% or below, ideally 0%, with respect to the circle-equivalent diameters thereof.

Then, color photosensitive materials for picture-taking and print-making uses are both described below.

Silver halide photographic emulsions usable in the invention can be prepared using the methods as described, e.g., in *Research Disclosure* (hereinafter abbreviated as "RD"), No. 17643, pp. 22–23, entitled "I. Emulsion Preparation and Types" (December 1978), ibid., No. 18716, p. 648 (November 1979), ibid., No. 307105, pp. 863–865 (November 1989); P. Glafkides, *Chemie et Physique Photographique,* Paul Montel (1967); G. F. Dufin, *Photographic Emulsion Chemistry,* The Focal Press (1966); and V. L. Zelikman, et al., *Making and Coating Photographic Emulsion,* The Focal Press (1964).

The monodisperse emulsions disclosed in U.S. Pat. Nos. 3,574,628 and 3,655,394, and GB No. 1,413,748 are also used to advantage.

The tabular grains having an aspect ratio of about 3 or above can also be used in the invention. Such tabular grains can be prepared with ease in accordance with the methods as described in Gutoff, *Photographic Science and Engineering,* vol. 14, pp. 248–257 (1970), U.S. Pat. Nos. 4,434,226, 4,414,310, 4,439,048 and 4,439,520, and GB No. 2,112,157.

Emulsion grains used in the invention may be uniform throughout in crystal structure, they may be different in halide composition between the inner part and the outer part, or they may form a layer structure. Further, silver halide phases differing in halide composition may be joined together by epitaxial junction, or compounds other than silver halide, such as silver rhodanide and zinc oxide, may bonded to a silver halide phase. In addition, mixtures of grains having different crystal forms may be used.

The emulsions may have any types of latent images. In other words, the emulsions used may be emulsions of the type which form latent images predominantly at the surface of grains (surface latent-image type), or emulsions of the type which mainly form latent images inside the grains (inside latent-image type), or emulsions of the type which form latent images in both surface and inner parts. However, they are required to be negative emulsions. As to the inside latent-image type emulsions, the core/shell emulsion of inside latent-image type as disclosed in Japanese Patent Laid-Open No. 264740/1988 may be used, and can be prepared by the method disclosed in Japanese Patent Laid-Open No. 133542/1984. The suitable shell thickness of this emulsion, though varies depending on the conditions of development-processing used, is in the range of 3 to 40 nm, preferably 5 to 20 nm.

Before using silver halide emulsions, the emulsions are subjected to physical ripening, chemical ripening and spectral sensitization. The additives used at these steps are described in RD No. 17643, RD No. 18716 and RD No. 307105, and the locations where they are described in each of those references are listed below.

In color photographic materials to which the present processing chemicals are applied, a mixture of two or more light-sensitive silver halide emulsions differing in at least one characteristic, grain size, grain size distribution, halide composition, grain shape or sensitivity, can be incorporated in one constituent layer.

It is advantageous to use the surface-fogged silver halide grains disclosed in U.S. Pat. No. 4,082,553d, the inside-fogged silver halide grains disclosed in U.S. Pat. No. 4,626,498 and Japanese Patent Laid-Open No. 214852/1984, or colloidal silver in light-sensitive silver halide emulsion layers and/or substantially light-insensitive hydrophilic colloidal layers. The term "inside- or surface-fogged silver halide grains" as used herein refers to the silver halide grains capable of being developed uniformly (non-imagewise) irrespective of whether they are present in the unexposed area or the exposed area of photosensitive material. The preparation methods of such grains are described in U.S. Pat. No. 4,626,498 and Japanese Patent Laid-Open No. 214852/1984. The silver halide forming the core of an inside-fogged core/shell silver halide grains may have a different halide composition. The silver halide used for forming inside- or surface-fogged grains may be any of silver chloride, silver chlorobromide, silver iodobromide and silver chloroiodobromide.

The photographic additives usable in color photographic materials are also described in RDs, and the locations at which they are described are shown below.

| Kinds of Additives | RD-17643 | RD-18716 | RD-307105 |
|---|---|---|---|
| 1. Chemical sensitizer | p. 23 | p. 648, right column | p. 866 |
| 2. Sensitivity increasing agent | | p. 648, right column | |
| 3. Spectral sensitizer and Supersensitizer | pp. 23–24 | p. 648, right column, to p. 649, right column | pp. 866–868 |

-continued

| Kinds of Additives | RD-17643 | RD-18716 | RD-307105 |
|---|---|---|---|
| 4. Brightening agent | p. 24 | p. 647, right column | p. 868 |
| 5. Light absorbent, Filter dye, UV absorbent | pp. 25–26 | p. 649, right column, to p. 650, left column | p. 873 |
| 6. Binder | p. 26 | p. 651, left column | pp. 873–874 |
| 7. Plasticizer, Lubricant | p. 27 | p. 650, right column | p. 876 |
| 8. Coating aid, Surfactant | pp. 26–27 | p. 650, right column | pp. 875–876 |
| 9. Antistatic agent | p. 27 | p. 650, right column | pp. 876–877 |
| 10. Matting agent | | | pp. 878–879 |

Various kinds of dye-forming couplers can be used in color photosensitive materials. The couplers recited below are preferred in particular.

Examples of yellow couplers used preferably include the couplers represented by formulae (I) and (II) in EP-A-502424, the couplers represented by formulae (1) and (2) in EP-A-51496 (especially Y-28 illustrated on page 18), the couplers represented by formula (I) in claim 1 of EP-A-568037, the couplers represented by formula (I) on column 1, lines 45–55, of U.S. Pat. No. 5,066,576, the couplers represented by formula (I) in paragraph [0008] of Japanese Patent Laid-Open No. 274425/1992, the couplers described in claim 1 on page 40 of EP-A1-498381 (especially D-35 illustrated on page 18), the couplers represented by formula (Y) on page 4 of EP-A1-447969 (especially Y-1 on page 17 and Y-54 on page 41), and the couplers represented by formulae (II) to (IV) on column 7, lines 36–58, of U.S. Pat. No. 4,476,219 (especially II-17, II-19 (on column 17) and II-24 (on column 19)).

Examples of magenta couplers used preferably include the couplers disclosed in Japanese Patent Laid-Open No. 39737, L-57 (p. 11, lower right), L-68 (p. 12, lower right) and L-77 (p. 13, lower right); the couplers disclosed in European Patent No. 456,257, A-4–63 (p. 134), A-4–73 and A-4–75 (p. 139); the couplers disclosed in European Patent No. 486,965, M-4, M-6 (p. 26), and M-7 (p. 27); the couplers disclosed in EP-A-571959, M-45 (p. 19); the coupler disclosed in Japanese Patent Laid-Open No. 204106/1993, M-1 (p. 6); and the coupler disclosed in Japanese Patent Laid-Open No. 362631/1992, M-22 (paragraph 0237).

Examples of cyan couplers used preferably include the couplers disclosed in Japanese Patent Laid-Open No. 204843/1992, CX-1, 3, 4, 5, 11, 12, 14 and 15 (pp. 14–16); the couplers disclosed in Japanese Patent Laid-Open No. 43345/1992, C-7, C-10 (p. 35), C-34, C-35 (p. 37), (I-1) and (I-17) (pp. 42–43); and the couplers represented by formulae (Ia) and (Ib) in claim 1 of Japanese Patent Laid-Open No. 67385/1994.

As suitable examples of polymeric couplers, mention may be made of the couplers disclosed in Japanese Patent Laid-Open No. 44345/1990, P-1 and P-5 (p. 11).

As couplers capable of forming colored dyes having moderate diffusibility, those disclosed in U.S. Pat. No. 4,366,237, GB No. 2,125,570, EP-B-96873 and DE No. 3,234533 are preferred.

As couplers for compensating undesired absorption of developed colors, the yellow colored cyan couplers represented by formulae (CI), (CII), (CIII) and (CIV) illustrated on page 5 of EP-A1-456257 (especially YC-86 on page 84), the yellow colored magenta couplers ExM-7 (p. 202), EX-1 (p. 249) and EX-7 (p. 251) disclosed in the document cited above, the magenta colored cyan couplers CC-9 (column 8) and CC-13 (column 10) of U.S. Pat. No. 4,833,069, and the colorless masking couplers disclosed in U.S. Pat. No. 4,837,136 ((2) on column 8) and as formula (A) in claim 1 of WO92/11575 (especially the exemplified compounds on pages 36–45) are preferred.

As examples of photographically useful group-releasing compounds which can be incorporated, mention may be made of the development inhibitor-releasing compounds represented by formulae (I), (II), (III) and (IV) on page 11 of EP-A1-378236, the bleach accelerator-releasing compounds represented by formulae (1) and (1') on page 5 of EP-A20-310125, the ligand-releasing compounds represented by LIG-X in claim 1 of U.S. Pat. No. 4,555,478, the leuco dye-releasing compounds exemplified as Compounds 1–6 on columns 3–8 of U.S. Pat. No. 4,749,641, the fluorescent dye-releasing compounds disclosed in claim 1 of U.S. Pat. No. 4,774,181, the development accelerator- or fogging agent-releasing compounds represented by formulae (1), (2) and (3) on column 3 of U.S. Pat. No. 4,656,123, and the compounds represented by formula (I) in claim 1 of U.S. Pat. No. 4,857,447, which release groups capable of being converted to dyes only by undergoing elimination.

As examples of additives, other than couplers, which can be added, mention may be made of known dispersing media for oil-soluble organic compounds, latices for impregnation with oil-soluble organic compounds, scavengers for oxidized color developing agents, stain inhibitors, discoloration inhibitors, hardeners, precursors of development inhibitors, stabilizers, antifoggants, chemical sensitizers, dyes, dispersions of microcrystalline dyes, and UV absorbers.

The present invention can be applied to processing of various kinds of color photosensitive materials including color negative films for amateur use or motion picture use, color reversal films for slide or television use, color photographic paper and color positive films. In addition, the application to the lens-equipped film units disclosed in Japanese Patent Publication No. 32615/1990 and Japanese Utility Model Publication No. 39784/1991 is also favorable.

As examples of supports suitable for color photosensitive materials to which the present processing chemicals are applied, mention may be made of the materials as disclosed in the above-cited RD No. 17643, p. 28, ibid., No. 18716, p. 647, right column, to p. 648, left column, and ibid., No. 307105, p. 879.

It is appropriate that the color photosensitive materials to which the present processing chemicals are applied be provided with hydrophilic colloid layers (referred to as backing layers) having a total dry thickness of 2 to 20 μm on the side opposite to the emulsion layer side. Preferably, these backing layers contain the additives as recited above, such as light absorbents, filter dyes, ultraviolet absorbents, antistatic agents, hardeners, binders, plasticizers, lubricants, coating aids and surfactants. The suitable rate of swelling caused in the total backing layers is from 150 to 500%.

The color photosensitive materials to which the present processing chemicals are applied have magnetic recording layers in many cases.

The term "magnetic recording layer" as used herein is defined as the layer formed by coating on a support a coating composition made up of magnetic particles dispersed in a binder and an aqueous or organic solvent. Additionally, the descriptions in the paragraphs [0162] to [0166] of Japanese Patent Laid-Open No. 2001-92090 hold for the magnetic recording layers of photosensitive materials to which the present processing and processing chemicals are applicable.

In color photographic paper for color prints, a reflective support is utilized. As the reflective support, a support material laminated with a plurality of waterproof resin layers, such as polyethylene or polyester layers, and containing a white pigment, such as titanium dioxide, in at least one of the waterproof resin layers is preferred in particular.

Further, it is advantageous that a brightening agent is added to at least one of the waterproof resin layers. In another way, the brightening agent may be dispersed in a hydrophilic colloid layer of the photographic paper. Examples of a brightening agent suitably added to such layers include benzoxazole-type, coumarin-type and pyrazoline-type brightening agents. Of these brightening agents, the benzoxazolylnaphthalene-type and the benzoxazolylstilbene-type brightening agents are preferred over the others. Such a brightening agent has no particular restriction as to the amount used, but preferably it is added in an amount of 1 to 100 mg/m$^2$. When the brightening agent is mixed with a waterproof resin, its proportion to the waterproof resin is from 0.0005 to 3 weight %, preferably from 0.001 to 0.5 weight %.

As the reflective support, it is also allowable to use a material prepared by coating a white pigment-containing hydrophilic colloid layer on a transparent support or the reflective support as recited above.

In addition, the reflective support may be a support having a mirror-reflective or secondary diffuse-reflective metallic surface.

In picture-taking color photosensitive materials, cellulose triacetate and polyester supports are used. For details of these support materials the descriptions in *Koukai Giho* (which means "Journal of Technical Disclosure"), Kougi No. 94-6023, Hatsumei Kyoukai (referred to as JIII) (Mar. 15, 1994) can be referred to.

Polyesters are prepared using diol compounds and aromatic carboxylic acids as essential components. Examples of aromatic carboxylic acids usable therein include 2,6-, 1,5-, 1,4- and 2,7-napthalenedicarboxylic acids, terephthalic acid and isophthalic acid, and examples of diol compounds usable therein include diethylene glycol, triethylene glycol, cyclohexane dimethanol, bisphenol A and bisphenol. As examples of polymers prepared by polymerization of those compounds, mention may be made of homopolymers, such as polyethylene terephthalate, polyethylene naphthalate, and polycyclohexanedimethanol terephthalate. Of such polymers, polyesters containing 50 to 100 mole % of 2,5-napthalenedicarboxylic acid as the carboxylic acid component are preferred over the others. In particular, polyethylene 2,6-naphthalate is used to advantage. The average molecular weight of polyesters usable herein is from about 5,000 to about 200,000. The Tg of polyesters used in the invention is 50° C. or above, preferably 90° C. or above.

These polyesters may be kneaded with ultraviolet absorbents. In another way, the prevention of light piping can be effected by kneading polyesters with dyes or pigments made available for polyester use, such as Diaresin produced by Mitsubish Chemical Co., and Kayaset produced by Nippon Kayaku Co., Ltd.

The supports used in photosensitive materials to be treated with the present processing chemicals are preferably subjected to surface treatment directly or after coated with subbing layers for the purpose of bonding them to constituent layers of the photosensitive materials. Examples of such surface treatment include surface activation treatments, such as chemical treatment, mechanical treatment, corona discharge treatment, flame treatment, UV treatment, high-frequency treatment, glow discharge treatment, activated plasma treatment, laser treatment, mixed acid treatment and ozonolysis treatment. Of these surface treatments, UV irradiation treatment, flametreatment, corona treatment and glow treatment are preferred over the others.

In photosensitive materials to be treated with the present processing chemicals, it is preferable to use antistatic agents. Examples of such antistatic agents include carboxylic acids and the salts thereof, polymers containing sulfonates, cationic polymers and ionic surface-active compounds.

However, the antistatic agent most advantageously used is crystalline fine particles of at least one metal oxide having volume resistivity of $10^7$ Ω·cm or below, preferably $10^5$ Ω·cm or below, and their particle sizes in the range of 0.001 to 1.0 μm, which is selected from the group consisting of zinc oxide, silicon dioxide, titanium dioxide, alumina, indium oxide, magnesium oxide, barium oxide, manganese oxide and vanadium oxide, or fine particles of compound oxides formed from those metal oxides (wherein Sb, P, B, In, S, Si or/and C are included), or fine particles of sol-state metal oxides or compound oxides formed therefrom. The suitable content of such fine particles in a photosensitive material is from 5 to 500 mg/m$^2$, preferably from 10 to 350 mg/m$^2$. The suitable ratio of the addition amount of conductive crystalline oxides or compound oxides formed therefrom to the amount of binders used is from 1/300 to 100/1, preferably 1/100 to 100/5.

It is appropriate to impart slippability to color photosensitive materials used in the invention. Further, slip agent-containing layers are preferably provided on both photosensitive-layer and backing-layer sides. The suitable slippability is from 0.25 to 0.01 as expressed in terms of coefficient of kinetic friction. The measurement for determining such slippability is made under a condition that a test sample is moved against a stainless ball having a diameter of 5 mm at a rate of 60 cm/min (at 25°, 60% RH). In this evaluation, the value on the same level is obtained even when the material against which the test sample is moved is replaced by the photosensitive layer surface.

Examples of a slip agent usable therein include polyorganosiloxanes, higher fatty acid amides, metal salts of higher fatty acids, and esters of higher fatty acids and higher alcohol compounds. As the polyorganosiloxanes, polydimethylsiloxane, polydiethylsiloxane, polystyryl-methylsiloxane and polymethylphenylsiloxane can be used. The layers to which such slip agents can be added are preferably the outermost layer of emulsion layers and a backing layer. Especially preferred slip agents are polydimethylsilocane and esters having long-chain alkyl groups.

It is also appropriate that matting agents be present in the color photosensitive materials. The matting agents may be present on any side, the emulsion layer side or the baking side. In particular, it is advantageous to add them to the outermost layer on the emulsion layer side. The matting agents may be soluble in processing solutions or insoluble therein. The combined use of matting agents of these two types is effective. As matting agents, polymethyl methacrylate particles, methyl methacrylate/methacrylic acid (9/1 to 5/5 by mole) copolymer particles and polystyrene particles are preferred. The suitable particle sizes of those polymers are in the range of 0.8 to 10 μm. As to the particle size distribution, the narrower, the better. More specifically, it is appropriate that at least 90% of the total number of particles be particles having their respective sizes in the range of 0.9 to 1.1 times the average size. For enhancing the matting capability, it is effective to add fine particles smaller than 0.8

μm in size and the aforementioned particles simultaneously. Examples of such fine particles include polymethyl methacrylate particles (0.2 μm), methyl methacrylate/methacrylic acid (9/1 by mole) copolymer particles (0.3 μm), polystyrene particles (0.25 μm) and colloidal silica (0.03 μm).

The present invention will now be described in more detail by way of the following examples. However, the invention should not be construed as being limited to these examples.

EXAMPLE 1

Tests on Photographic Properties

[1] Preparation of Photosensitive Materials for Testing

<Support>

The support used in Examples was prepared in the following manner.

1) First and Subbing Layers

A 90 μm-thick polyethylene naphthalate support underwent glow discharge treatment on both sides under a condition that the pressure of a processing atmosphere was 2.66×10 Pa, the partial pressure of $H_2O$ in the atmospheric gas was 75%, the discharge frequency was 30 kHz, the output was 2,500 W and the processing intensity was 0.5 kV·A·min/m$^2$. On this support, a coating solution having the following composition was coated at a coverage of 5 mL/m$^2$ as the first layer in accordance with the bar coating method disclosed in Japanese Patent Publication No. 4589/1983.

| | |
|---|---|
| Electrically conductive fine-grain dispersion (concentration of $SnO_2/Sb_2O_5$ grains in aqueous dispersion: 10%, average grain size of secondary condensates constituted of primary grains having a diameter of 0.005 μm: 0.05 μm) | 50 parts by weight |
| Gelatin | 0.5 parts by weight |
| Water | 49 parts by weight |
| Polyglycerol polyglycidyl ether | 0.16 parts by weight |
| Poly (polymerization degree: 20) oxyethylene sorbitan monolaurate | 0.1 parts by weight |

After coating the first layer, the support was annealed by being wound onto a stainless roll having a diameter of 20 cm and subjected to heat treatment at 110° C. (Tg of PEN support: 119° C.) for 48 hours to give thermal hysteresis thereto. Then, the following composition was coated at a coverage of 10 mL/m$^2$ as a subbing layer for emulsions on the side of the support opposite to the first layer in accordance with the bar coating method.

| | |
|---|---|
| Gelatin | 1.01 parts by weight |
| Salicylic acid | 0.30 parts by weight |
| Resorcinol | 0.40 parts by weight |
| Poly (polymerization degree: 20) oxyethylene nonyl phenyl ether | 0.11 parts by weight |
| Water | 3.53 parts by weight |
| Methanol | 84.57 parts by weight |
| n-Propanol | 10.08 parts by weight |

Further, the second and third layers mentioned below were coated on the first layer in the order described, and finally the color negative photosensitive layers having the following compositions were coated in multiple layers on the opposite side, thereby preparing a silver halide emulsion-provided transparent magnetic recording medium.

2) Second Layer (Transparent Magnetic Recording Layer)

(i) Dispersion of Magnetic Material:

In an open kneader, 1,100 parts by weight of Co-doped γ-$Fe_2O_3$ magnetic substance (average major axis length: 0.25 μm, $S_{BET}$: 39 m$^2$/g, Hc: 6.56×10$^4$ A/m, σs: 77.1 Am$^2$/kg, σr: 37.4 Am2/kg), 220 parts by weight of water and 165 parts by weight of a silane coupling agent [3-(poly(polymerization degree: 10) oxy-ethynyl)oxypropyltrimethoxysilane] were mixed and thoroughly kneaded for 3 hours. The rough dispersion thus obtained was viscous, and it was dried at 70° C. for one day to remove water. Thereafter, heating treatment was carried out at 110° C. for 1 hour, thereby preparing surface-treated magnetic particles.

Further, the composition containing the following ingredients was kneaded for 4 hours by using the open kneader again.

| | |
|---|---|
| Surface-treated magnetic particles described above | 855 g |
| Diacetyl cellulose | 25.3 g |
| Methyl ethyl ketone | 136.3 g |
| Cyclohexanone | 136.3 g |

Furthermore, the dispersion obtained was subjected to fine dispersion by using a sand mill at 2,000 rpm for 4 hours. The dispersing medium used herein was glass beads of 1 mm φ.

| | |
|---|---|
| Kneaded dispersion described above | 45 g |
| Diacetyl cellulose | 23.7 g |
| Methyl ethyl ketone | 127.7 g |
| Cyclohexanone | 127.7 g |

In addition, the magnetic substance-containing intermediate dispersion was prepared in according to the following formula.

(ii) Preparation of Magnetic Substance-Containing Intermediate Solution:

| | |
|---|---|
| Fine dispersion of magnetic substance described above | 674 g |
| Diacetyl cellulose solution (solids content: 4.34%, solvent: methyl ethyl ketone/cyclohexanone = 1/1) | 24,280 g |
| Cyclohexanone | 46 g |

These ingredients were mixed, and stirred with a disper to prepare the magnetic substance-containing intermediate solution.

An α-alumina abrasive dispersion was prepared according to the following formula.

(a) Preparation of Dispersion of Sumicorundum AA-1.5 Particles (Average Size of Primary Particles: 1.5 μm, Specific Surface Area: 1.3 m$^2$/g):

| | |
|---|---|
| Sumicorundum AA-1.5 | 152 g |
| Silane coupling agent KBM903 (produced by Shin-Etsu Silicone Co., Ltd.) | 0.48 g |
| Diacetyl cellulose solution (solids content: 4.5%, solvent: methyl ethyl ketone/cyclohexanone = 1/1) | 227.52 g |

The aforementioned amounts of ingredients underwent 4-hour fine dispersion by using a ceramic-coated sandmill (1/4G sandmill) at 800 rpm. The dispersing medium used herein was zirconia beads of 1 mm ϕ.

(b) Dispersion of Colloidal Silica Particles (Fine Particles):

The dispersion used was MEK-ST produced by Nissan Chemical Industries, Ltd. This product is a dispersion of colloidal silica wherein the dispersing medium is methyl ethyl ketone, the average size of primary particles is 0.015 μm and the solids content is 30%.

(iii) Preparation of Coating Solution for Second Layer:

| | |
|---|---|
| Magnetic substance-containing intermediate solution | 1,9053 g |
| Diacetyl cellulose solution (solids content: 4.5%, solvent: methyl ethyl ketone/cyclohexanone = 1/1) | 264 g |
| Colloidal silica dispersion, MEK-ST (Dispersion (b), solids content: 30%) | 128 g |
| Sumicorundum AA-1.5 dispersion (Dispersion (a)) | 12 g |
| Dilute solution of Mirionate MR-400 (produced by Nippon Polyurethane Industry Co., Ltd., solids content: 20%, diluent: methyl ethyl ketone/cyclohexanone (1/1)) | 203 g |
| Methyl ethyl ketone | 170 g |
| Cyclohexanone | 170 g |

These ingredients were mixed with stirring, and coated with a wire bar so as to have a coverage of 29.3 mL/m$^2$. The drying was carried out at 110° C. After drying the magnetic layer formed had a thickness of 1.0 μm.

3) Third Layer (Higher Fatty Acid Ester Slip Agent-containing Layer)

(i) Preparation of Undiluted Dispersion of Slip Agent:

The following mixture (a) was heated at 100° C., and then added to liquid (b), and further dispersed with a high-pressure homogenizer. Thus, an undiluted dispersion of slip agent was prepared.

| | |
|---|---|
| Mixture (a) | |
| $C_6H_{13}CH(OH)(CH_2)_{10}COOC_{50}H_{101}$ | 399 parts by weight |
| n-$C_{50}H_{101}O(CH_2CH_2O)_{16}H$ | 171 parts by weight |
| Cyclohexanone | 830 parts by weight |
| Liquid (b) | |
| Cyclohexanone | 8,600 parts by weight |

(ii) Preparation of Dispersion of Spherical Inorganic Particles:

A dispersion of spherical inorganic particles, [c1], was prepared according to the following formula;

| | |
|---|---|
| Isopropyl alcohol | 93.54 parts by weight |
| Silane coupling agent KBM903 (produced by Shin-Etsu Silicones) | |
| Compound 1-1: $(CH_3O)_3Si—(CH_2)_3—NH_2$) | 5.53 parts by weight |
| Compound 1: | 2.93 parts by weight |

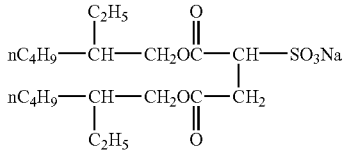

| | |
|---|---|
| Seahosta KEP50 (amorphous spherical silica, average particle diameter: 0.5 μm, produced by Nippon Shokubai Co., Ltd.) | 88.00 parts by weight |

The foregoing amounts of ingredients were stirred for 10 minutes, and thereto the following ingredient was further added.

| | |
|---|---|
| Diacetone alcohol | 252.93 parts by weight |

The mixture obtained was cooled with stirring in an ice bath, and dispersed for 3 hours with a ultrasonic homogenizer, SONIFIER 450 (made by Branson Ultrasonics Corporation). Thus, the dispersion of spherical inorganic particles, [c1], was completed.

(iii) Preparation of Dispersion of Spherical Organic Polymer Particles:

A dispersion of spherical organic polymer particles, [c2], was prepared according to the following formula;

| | |
|---|---|
| XC99-A8808 (produced by Toshiba Silicones, spherical cross-linked polysiloxane particles, average particle diameter: 0.9 μm) | 60 parts by weight |
| Methyl ethyl ketone | 120 parts by weight |
| Cyclohexanone | 120 parts by weight |

These ingredients in the aforementioned amounts were made into a dispersion [c2] (solids content: 20%, solvent: methyl ethyl ketone/cyclohexanone=1/1) while cooling in an ice bath and stirring for 2 hours by use of an ultrasonic homogenizer, SONIFIER 450 (made by Branson Ultrasonics Corporation).

(iv) Preparation of Coating Composition for Third Layer:

To 542 g of the foregoing undiluted slip agent dispersion, the following ingredients were added to prepare a coating solution for the third layer.

| | |
|---|---|
| Diacetone alcohol | 5,950 g |
| Cyclohexanone | 170 g |
| Ethyl acetate | 1,700 g |
| Seahosta KEP 50 dispersion [c1] mentioned above | 53.1 g |
| Dispersion [c2] of spherical organic polymer particles mentioned above | 300 g |
| FC431 | 2.65 g |

-continued

| | |
|---|---|
| (produced by 3M, solids content: 50%, solvent: ethyl acetate) | |
| BYK310 (produced by BYK Chemi Japan, solids content: 25%) | 5.3 g |

On the second layer, the coating composition for the third layer was coated at a coverage of 10.35 mL/m2, and dried at 110° C. Subsequently thereto, the coating formed was dried for 3 minutes at 97° C.

<Photosensitive Layers>

On the side opposite to the backing layers, various layers having the following compositions are coated into multiple layers. Thus, a color negative film was prepared.

(Compositions of Photosensitive Layers)

The figure corresponding to each individual ingredient is a coverage expressed in the unit g/m$^2$, and the coverage concerning silver halide is indicated on a silver basis. (Specified compounds described below are represented by symbolic letters to which numbers are given respectively, and the chemical formulae thereof are illustrated hereinafter.)

| | | |
|---|---|---|
| First layer (First anti-halation layer) | | |
| Black colloidal silver | silver | 0.070 |
| Gelatin | | 0.608 |
| ExM-1 | | 0.035 |
| F-8 | | 0.001 |
| HBS-1 | | 0.050 |
| HBS-2 | | 0.002 |
| Second layer (Second anti-halation layer) | | |
| Black colloidal silver | silver | 0.089 |
| Gelatin | | 0.632 |
| ExF-1 | | 0.002 |
| F-8 | | 0.001 |
| Third layer (Interlayer) | | |
| Cpd-1 | | 0.082 |
| HBS-1 | | 0.043 |
| Gelatin | | 0.422 |
| Fourth layer (Low-speed red-sensitive emulsion layer) | | |
| Em-D | silver | 0.577 |
| Em-C | silver | 0.347 |
| ExC-1 | | 0.263 |
| ExC-2 | | 0.015 |
| ExC-3 | | 0.155 |
| ExC-4 | | 0.144 |
| ExC-5 | | 0.035 |
| ExC-8 | | 0.015 |
| Cpd-4 | | 0.025 |
| UV-2 | | 0.047 |
| UV-3 | | 0.086 |
| UV-4 | | 0.018 |
| HBS-1 | | 0.245 |
| HBS-5 | | 0.036 |
| Gelatin | | 0.994 |
| Fifth layer (Medium-speed red-sensitive emulsion layer) | | |
| Em-B | silver | 0.431 |
| Em-C | silver | 0.432 |
| ExC-1 | | 0.111 |
| ExC-2 | | 0.027 |
| ExC-3 | | 0.007 |
| ExC-4 | | 0.075 |
| ExC-5 | | 0.007 |
| ExC-6 | | 0.021 |
| ExC-8 | | 0.010 |

-continued

| | | |
|---|---|---|
| ExC-9 | | 0.005 |
| Cpd-2 | | 0.032 |
| Cpd-4 | | 0.020 |
| HBS-1 | | 0.098 |
| Gelatin | | 0.802 |
| Sixth layer (High-speed red-sensitive emulsion layer) | | |
| Em-A | silver | 1.214 |
| ExC-1 | | 0.070 |
| ExC-3 | | 0.005 |
| ExC-6 | | 0.026 |
| ExC-8 | | 0.109 |
| ExC-9 | | 0.020 |
| Cpd-2 | | 0.068 |
| Cpd-4 | | 0.020 |
| HBS-1 | | 0.231 |
| Gelatin | | 1.174 |
| Seventh layer (Interlayer) | | |
| Cpd-1 | | 0.073 |
| Cpd-6 | | 0.002 |
| HBS-1 | | 0.037 |
| Polyethyl acrylate latex | | 0.088 |
| Gelatin | | 0.683 |
| Eighth layer (Layer giving interimage effect to red-sensitive layers) | | |
| Em-J | silver | 0.153 |
| Em-K | silver | 0.153 |
| ExM-2 | | 0.086 |
| ExM-3 | | 0.002 |
| ExM-4 | | 0.025 |
| ExY-4 | | 0.041 |
| ExC-7 | | 0.026 |
| HBS-1 | | 0.218 |
| HBS-3 | | 0.003 |
| Gelatin | | 0.649 |
| Ninth layer (Low-speed green-sensitive emulsion layer) | | |
| Em-H | silver | 0.329 |
| Em-G | silver | 0.333 |
| Em-I | silver | 0.088 |
| ExM-2 | | 0.360 |
| ExM-3 | | 0.055 |
| ExY-3 | | 0.012 |
| ExC-7 | | 0.008 |
| HBS-1 | | 0.362 |
| HBS-3 | | 0.010 |
| HBS-4 | | 0.200 |
| Gelatin | | 1.403 |
| Tenth layer (Medium-speed green-sensitive emulsion layer) | | |
| Em-F | silver | 0.394 |
| ExM-2 | | 0.049 |
| ExM-3 | | 0.034 |
| ExY-3 | | 0.007 |
| ExC-7 | | 0.012 |
| ExC-8 | | 0.010 |
| HBS-1 | | 0.060 |
| HBS-3 | | 0.002 |
| HBS-4 | | 0.020 |
| Gelatin | | 0.474 |
| Eleventh layer (High-speed green-sensitive emulsion layer) | | |
| Em-E | silver | 0.883 |
| ExC-6 | | 0.007 |
| ExC-8 | | 0.011 |
| ExM-1 | | 0.021 |
| ExM-2 | | 0.092 |
| ExM-3 | | 0.015 |
| Cpd-3 | | 0.005 |
| Cpd-5 | | 0.010 |
| HBS-1 | | 0.176 |
| HBS-3 | | 0.003 |
| HBS-4 | | 0.070 |
| Polyethyl acrylate latex | | 0.099 |
| Gelatin | | 0.916 |
| Twelfth layer (Yellow filter layer) | | |

-continued

| | | |
|---|---|---|
| Cpd-1 | | 0.092 |
| Solid disperse dye ExF-2 | | 0.088 |
| HBS-1 | | 0.049 |
| Gelatin | | 0.603 |
| Thirteenth layer (Low-speed blue-sensitive emulsion layer) | | |
| Em-O | silver | 0.112 |
| Em-M | silver | 0.320 |
| Em-N | silver | 0.240 |
| ExC-1 | | 0.049 |
| ExC-7 | | 0.013 |
| ExY-1 | | 0.002 |
| ExY-2 | | 0.693 |
| ExY-4 | | 0.058 |
| HBS-1 | | 0.231 |
| Gelatin | | 1.553 |
| Fourteenth layer (High-speed blue-sensitive emulsion layer) | | |
| Em-L | silver | 0.858 |
| ExY-2 | | 0.357 |
| ExY-4 | | 0.068 |
| HBS-1 | | 0.124 |
| Gelatin | | 0.948 |
| Fifteenth layer (First protective layer) | | |
| 0.07 μm Silver iodobromide emulsion | silver | 0.245 |
| UV-1 | | 0.313 |
| UV-2 | | 0.156 |
| UV-3 | | 0.222 |
| UV-4 | | 0.022 |
| F-18 | | 0.007 |
| S-1 | | 0.068 |
| HBS-1 | | 0.175 |
| HBS-4 | | 0.020 |
| Gelatin | | 1.950 |
| Sixteenth layer (Second protective layer) | | |
| H-1 | | 0.358 |
| B-1 (diameter: 1.7 μm) | | 0.050 |
| B-2 (diameter: 1.7 μm) | | 0.150 |
| B-3 | | 0.050 |
| S-1 | | 0.200 |
| Gelatin | | 0.675 |

In order to improve keeping quality, processability, pressure resistance, anti-mold and anti-bacterial properties, antistatic properties and coatability, each layer further contained W-1 to W-6, B-4 to B-6, F-1 to F-17, and lead, platinum, iridium and rhodium salts in their respectively appropriate amounts.

Preparation of Dispersion of Organic Solid Disperse Dye:

ExF-2 used in the twelfth layer was dispersed in the following manner.

| | |
|---|---|
| Wet cake of ExF-2 (containing 17.6 weight % of water) | 2.800 kg |
| Sodium octylphenyldiethoxymethanesulfonate (31 weight % aqueous solution) | 0.376 kg |
| F-15 (7% aqueous solution) | 0.011 kg |
| Water | 4.020 kg |
| Total | 7.210 kg |

(pH was adjusted to 7.2 by use of NaOH)

The slurry having the foregoing composition was dispersed roughly by stirring with a dissolver, and further dispersed by using agitator mill LMK-4 under conditions that the peripheral speed was 10 m/s, the discharge rate was 0.6 kg/min and the filling percent of zirconia beads 0.3 mm in diameter was 80% until the absorbance ratio of the dispersion reached 0.29, thereby preparing a dispersion of solid fine particles. The fine particles of dyes thus dispersed had an average particle size of 0.29 μm.

TABLE 1

| Emulsion | Average iodide content (mole %) | Sphere-equivalent diameter (μm) | Aspect ratio | Circle-equivalent diameter (μm) | Grain thickness (μm) | Grain shape |
|---|---|---|---|---|---|---|
| Em-A | 4 | 0.92 | 14 | 2 | 0.14 | tablet |
| Em-B | 6 | 0.8 | 12 | 1.6 | 0.13 | tablet |
| Em-C | 4.7 | 0.51 | 7 | 0.85 | 0.12 | tablet |
| Em-D | 3.9 | 0.37 | 2.7 | 0.4 | 0.15 | tablet |
| Em-E | 5 | 0.92 | 14 | 2 | 0.14 | tablet |
| Em-F | 5.5 | 0.8 | 12 | 1.6 | 0.13 | tablet |
| Em-G | 4.7 | 0.51 | 7 | 0.85 | 0.12 | tablet |
| Em-H | 3.7 | 0.49 | 3.2 | 0.58 | 0.18 | tablet |
| Em-I | 2.8 | 0.29 | 1.2 | 0.27 | 0.23 | tablet |
| Em-J | 5 | 0.8 | 12 | 1.6 | 0.13 | tablet |
| Em-K | 3.7 | 0.47 | 3 | 0.53 | 0.18 | tablet |
| Em-L | 5.5 | 1.4 | 9.8 | 2.6 | 0.27 | tablet |
| Em-M | 8.8 | 0.64 | 5.2 | 0.85 | 0.16 | tablet |
| Em-N | 3.7 | 0.37 | 4.6 | 0.55 | 0.12 | tablet |
| Em-O | 1.8 | 0.19 | — | — | — | cube |

Making additional remarks about the emulsions listed in Table 1, Emulsions A to C were each spectrally sensitized by adding thereto Spectral Sensitizing Dyes 1 to 3 in optimum amounts, and further underwent gold sensitization, sulfur sensitization and selenium sensitization under optimum conditions. Emulsions E to G were each spectrally sensitized by adding thereto Spectral Sensitizing Dyes 4 to 6 in optimum amounts, and further underwent gold sensitization, sulfur sensitization and selenium sensitization under optimum conditions. Emulsion J was spectrally sensitized by adding thereto Spectral Sensitizing Dyes 7 and 8 in optimum amounts, and further underwent gold sensitization, sulfur sensitization and selenium sensitization under optimum conditions. Emulsion L was spectrally sensitized by adding thereto Spectral Sensitizing Dyes 9 to 11 in optimum amounts, and further underwent gold sensitization, sulfur sensitization and selenium sensitization under optimum conditions. Emulsion O was spectrally sensitized by adding thereto Spectral Sensitizing Dyes 10 to 12 in optimum amounts, and further underwent gold sensitization and sulfur sensitization under optimum conditions. Emulsions D, H, I, K, M and N were each spectrally sensitized by using the spectral sensitizing dyes set forth in Table 2 in most suitable amounts as shown in Table 2, and further underwent gold sensitization, sulfur sensitization and selenium sensitization under optimum conditions.

TABLE 2

| Emulsion | Sensitizing Dye | Amount added (mole/mole Ag) |
|---|---|---|
| Em-D | Sensitizing Dye 1 | $5.44 \times 10^{-4}$ |
| | Sensitizing Dye 2 | $2.35 \times 10^{-4}$ |
| | Sensitizing Dye 3 | $7.26 \times 10^{-6}$ |
| Em-H | Sensitizing Dye 8 | $6.52 \times 10^{-4}$ |
| | Sensitizing Dye 13 | $1.35 \times 10^{-4}$ |
| | Sensitizing Dye 6 | $2.48 \times 10^{-5}$ |
| Em-I | Sensitizing Dye 8 | $6.09 \times 10^{-4}$ |
| | Sensitizing Dye 13 | $1.26 \times 10^{-4}$ |
| | Sensitizing Dye 6 | $2.32 \times 10^{-5}$ |
| Em-K | Sensitizing Dye 7 | $6.27 \times 10^{-4}$ |
| | Sensitizing Dye 8 | $2.24 \times 10^{-4}$ |
| Em-M | Sensitizing Dye 9 | $2.43 \times 10^{-4}$ |
| | Sensitizing Dye 10 | $2.43 \times 10^{-4}$ |
| | Sensitizing Dye 11 | $2.43 \times 10^{-4}$ |
| Em-N | Sensitizing Dye 9 | $3.28 \times 10^{-4}$ |

TABLE 2-continued

| Emulsion | Sensitizing Dye | Amount added (mole/mole Ag) |
|---|---|---|
| | Sensitizing Dye 10 | $3.28 \times 10^{-4}$ |
| | Sensitizing Dye 11 | $3.28 \times 10^{-4}$ |

The sensitizing dyes used in the emulsions listed in Table 2 are illustrated below:

Sensitizing Dye 1

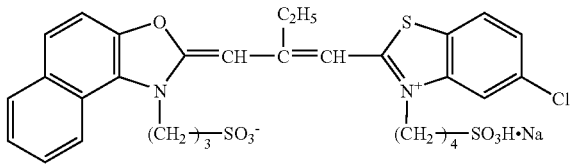

Sensitizing Dye 2

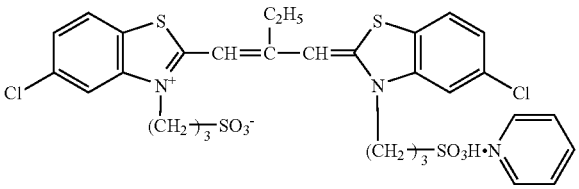

Sensitizing Dye 3

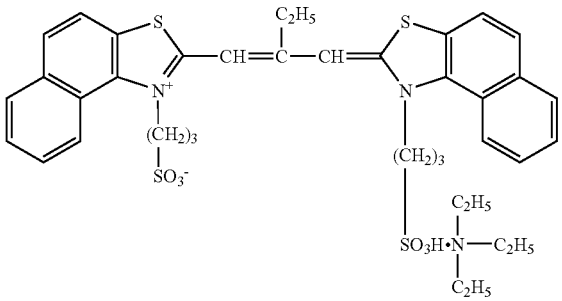

Sensitizing Dye 4

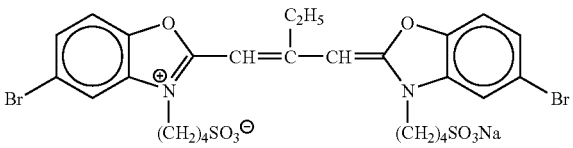

Sensitizing Dye 5

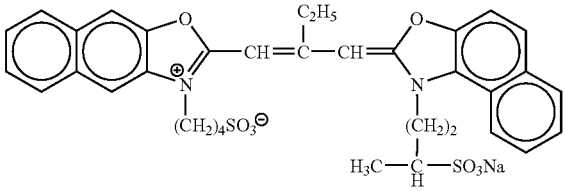

Sensitizing Dye 6

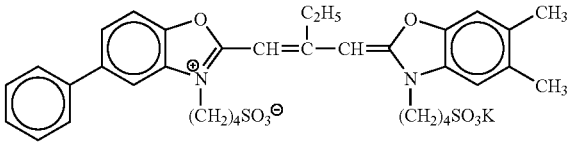

-continued

Sensitizing Dye 7

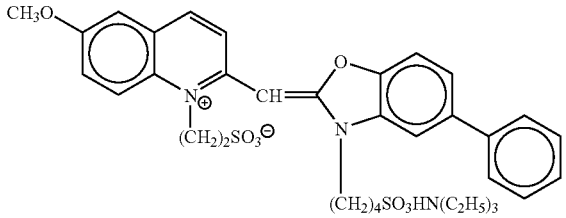

Sensitizing Dye 8

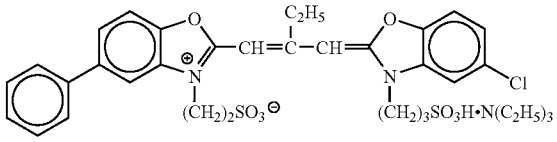

Sensitizing Dye 9

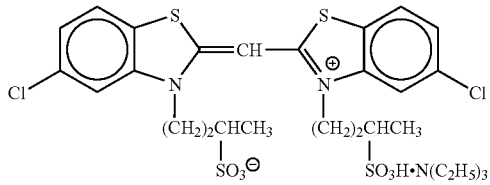

Sensitizing Dye 10

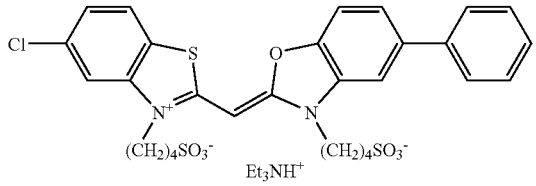

Sensitizing Dye 11

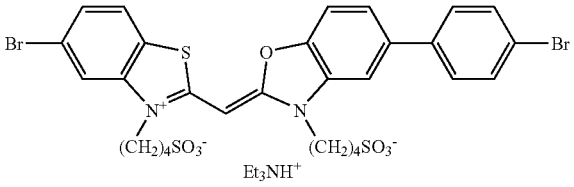

Sensitizing Dye 12

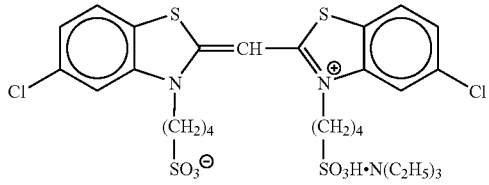

Sensitizing Dye 13

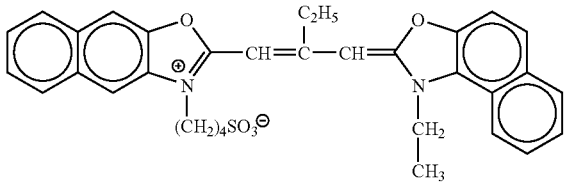

The emulsion grains tabular in shape were prepared using low molecular weight gelatin in accordance with Examples described in Japanese Patent Laid-Open No. 158426/1989.

In Emulsion A to K, Ir and Fe were contained in optimum amounts.

Emulsions L to O underwent reduction sensitization at the time of grain formation.

In the tabular grains, dislocation lines as described in Japanese Patent Laid-Open No. 237450/1991were observed under a high-pressure electron microscope.

In Emulsions A to C and Emulsion J, the dislocation was introduced by using an iodide ion releasing agent in accordance with Examples described in Japanese Patent Laid-Open No. 11782/1994.

In Emulsion E, the dislocation was introduced by using fine grains of silver iodide prepared in a separate chamber equipped with a magnetic coupling induction stirrer just before the addition.

The compounds used in each constituent layer are illustrated below:

ExC-1

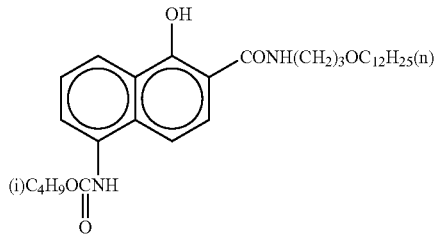

ExC-2

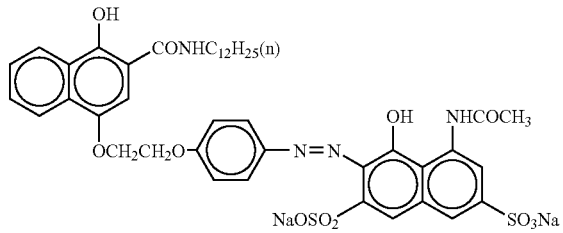

ExC-3

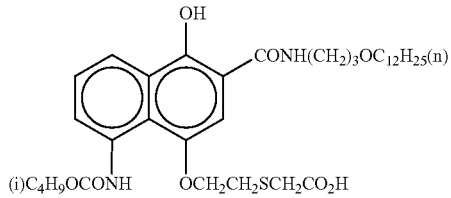

ExC-4

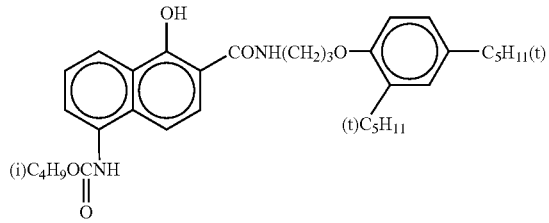

ExC-5

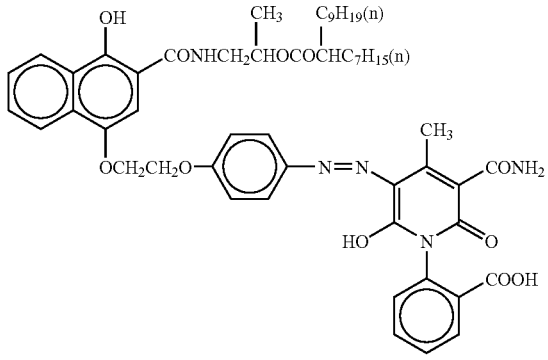

ExC-6

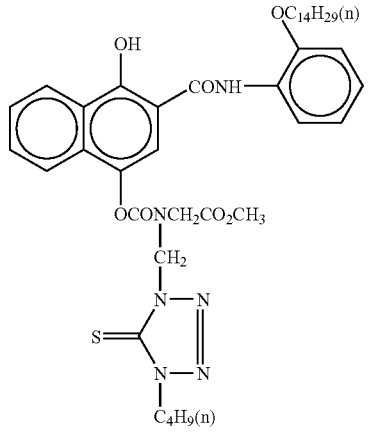

ExC-7

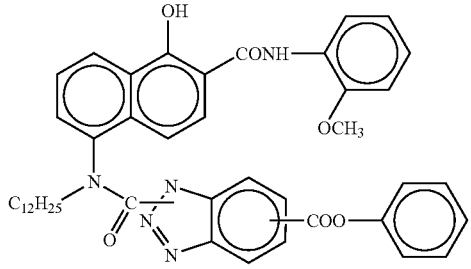

-continued
ExC-8
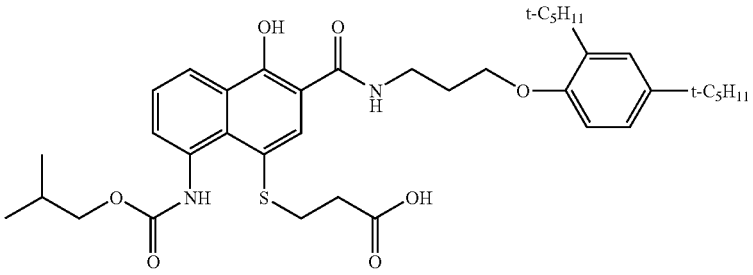
ExC-9
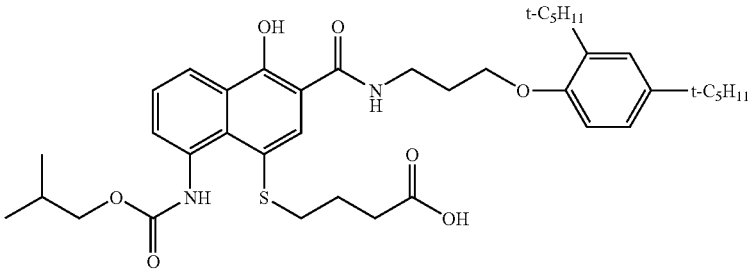
ExM-1
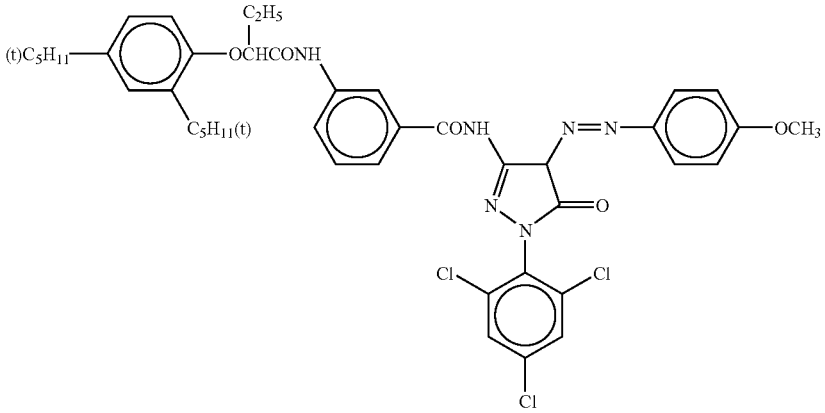
ExM-2
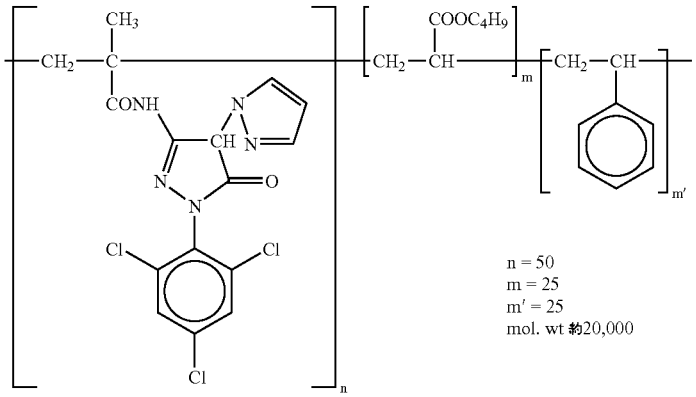

-continued
ExM-3
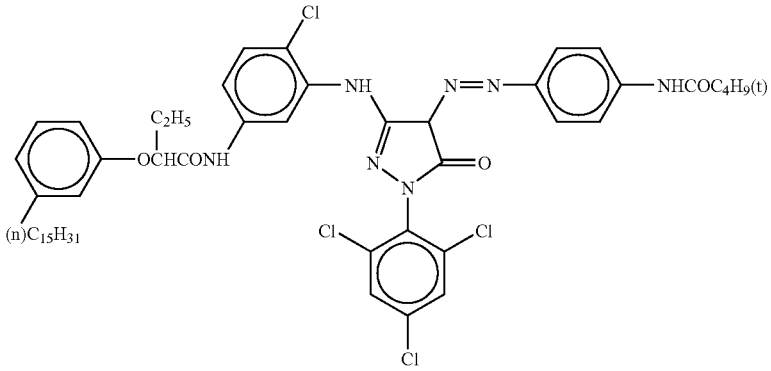
ExM-4
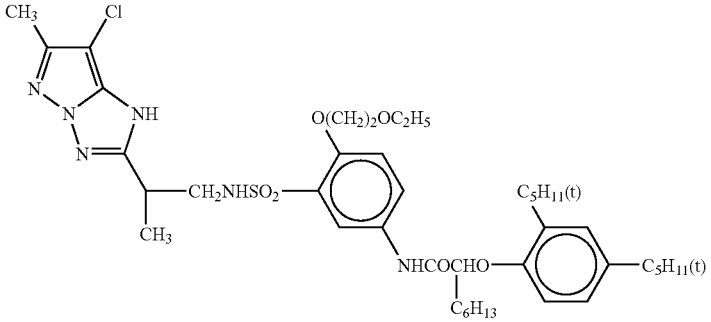
ExY-1
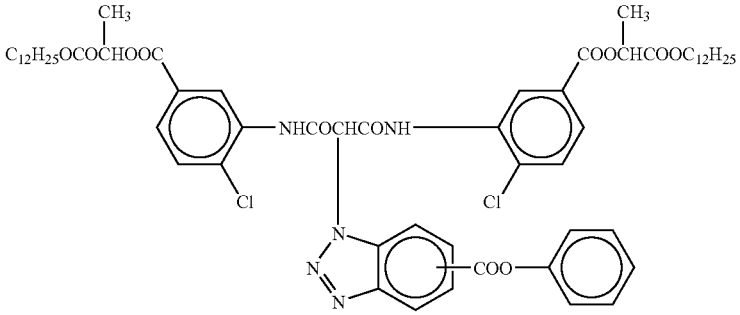
ExY-2
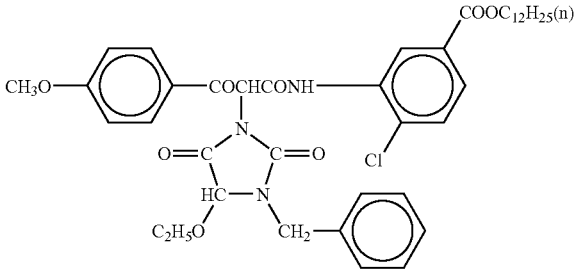
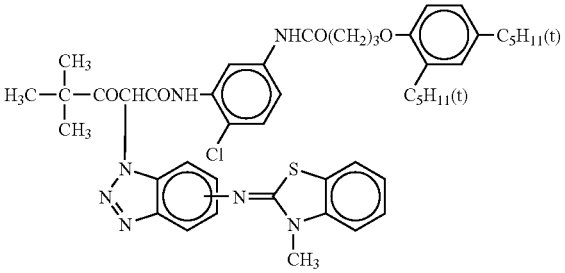
Cpd-1
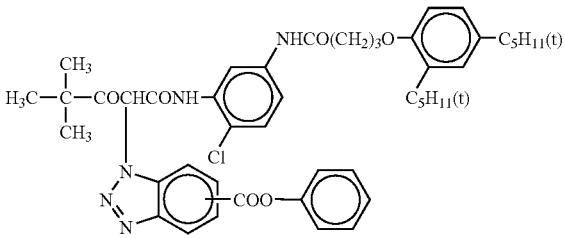
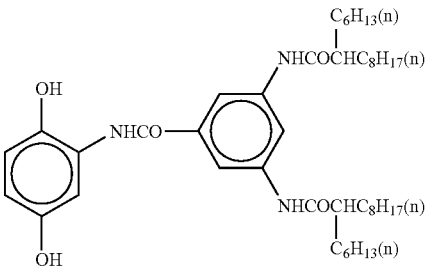

-continued
Cpd-2
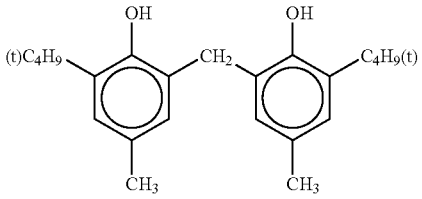
Cpd-3
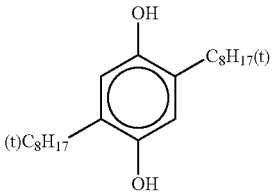
Cpd-4
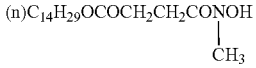
Cpd-5
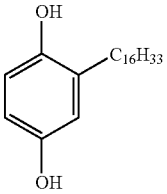
Cpd-6
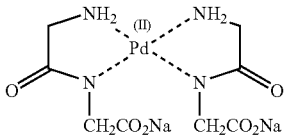
UV-1
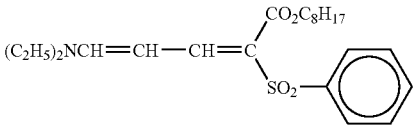
UV-2
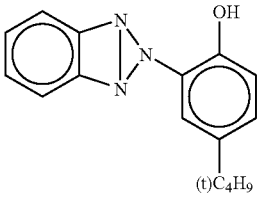
UV-3
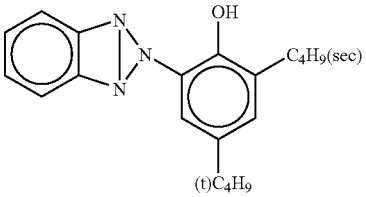
UV-4
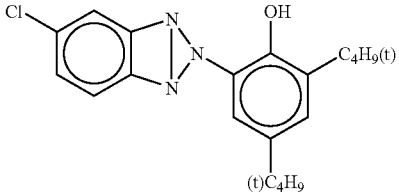
B-1
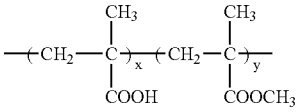
x/y = 10/90 (by weight)
average molecular weight:
about 35,000
B-2
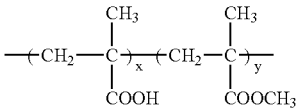
x/y = 40/60 (by weight)
average molecular weight:
about 20,000
B-3
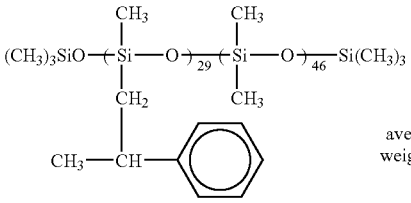
(by mole)
average molecular
weight: about 8,000
H-1
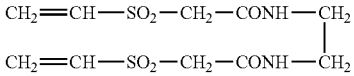
HBS-1
Tricresyl phosphate
HBS-2
Di-n-butyl phthalate
HBS-3
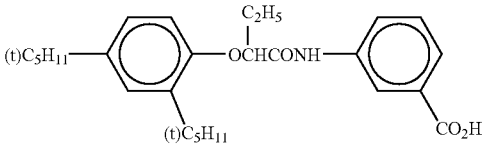

-continued
Tri(2-ethylhexyl)phosphate
HBS-4
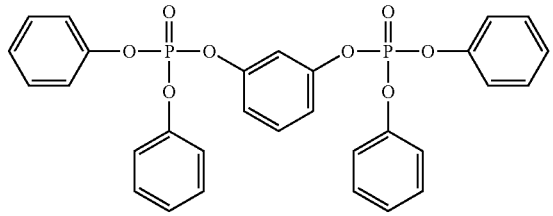
HBS-5
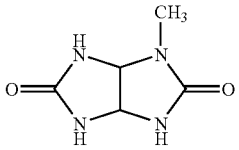
S-1
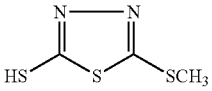
F-1
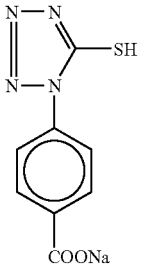
F-2
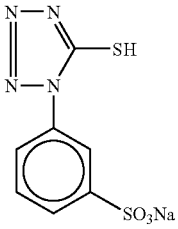
F-3
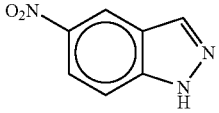
F-4
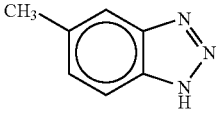
F-5
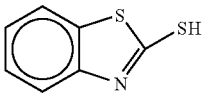
F-6
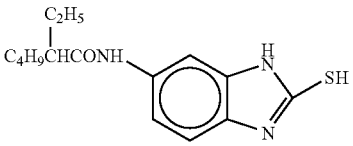
F-7
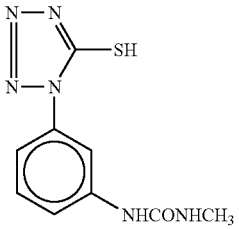
F-8
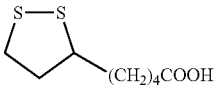
F-9
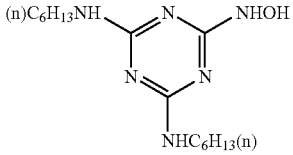
F-10
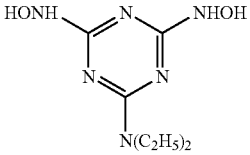
F-11
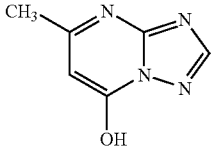
F-12
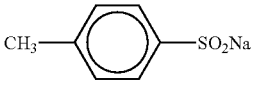
F-13

-continued
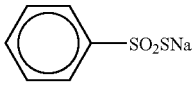
F-14
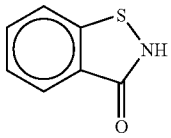
F-15
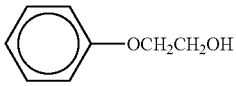
F-16
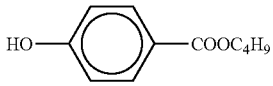
F-17
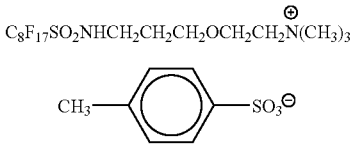
W-1
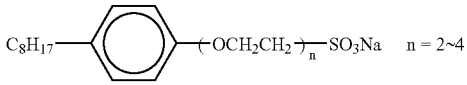
W-2
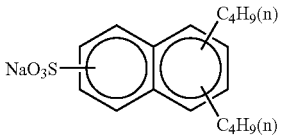
W-3
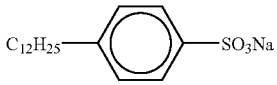
W-4
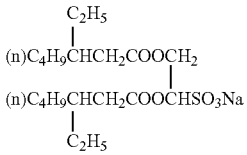
W-5
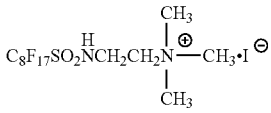
W-6
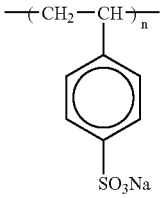
average molecular weight:
about 750,000
B-4
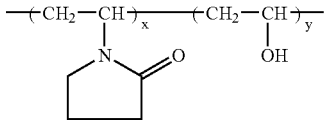
x/y = 70/80 (by weight)
average molecular weight:
about 17,000
B-5
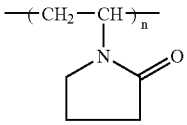
average molecular weight:
about 10,000
B-6
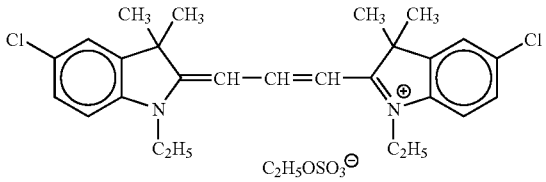
ExF-1
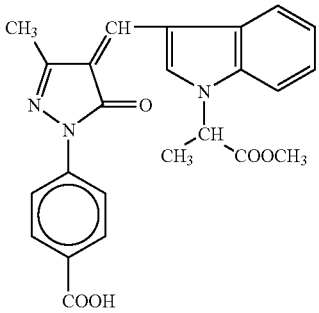
ExF-2

[3] Photographic Processing

Photographic processing was performed using the following color-negative developing apparatus in accordance with the processing specifications described below.

The developing apparatus used was an automatic processor FP-363SC made by Fuji Photo Film Co., Ltd.

Running processing with this automatic processor was performed using 5 rolls of the exposed sample film per day for 4 successive weeks. The evaluation was made by the film processed after such a long-term running processing.

Processing steps and compositions of processing solutions used are shown below.

Processing Process:

| Step | Processing time | Processing temp. | Replenisher volume*) | Tank volume |
|---|---|---|---|---|
| Color development | 3 min 5 sec | 38.0° C. | 15 ml | 10.3 L |
| Bleaching | 50 sec | 38.0° C. | 5 ml | 3.6 L |
| Fixing (1) | 50 sec | 38.0° C. | — | 3.6 L |
| Fixing (2) | 50 sec | 38.0° C. | 7.5 ml | 3.6 L |
| Rinsing (1) | 25 sec | 38.0° C. | — | 1.9 L |
| Rinsing (2) | 25 sec | 38.0° C. | — | 1.9 L |
| Rinsing (3) | 25 sec | 38.0° C. | 30 ml | 1.9 L |
| Drying | 90 sec | 70.0° C. | | |

*): Each replenisher volume shown above is per processed photosensitive material having an area of 35 mm (width) × 1.1 m (length) (equivalent to a roll of 24 exposures).

The rinsing tanks were replenished using a counter-current system from (3) to (2), and from (2) to (1). The fixing (2) was connected to the fixing (1) by counter-current plumbing. Further, the tank solution of Rinsing (2) was made to flow into the fixing solution (2) in a replenishment rate-equivalent amount of 15 ml. Additionally, the amount of developer brought into the bleaching step, the amount of bleaching solution brought into the fixing step (1) and the amount of fixing solution brought into the rinsing step (1) were each 2.0 ml per photosensitive material having an area of 35 mm×1.1 m. And a crossover time between every two successive steps was 6 seconds, which was included in the processing time of the preceding step.

The compositions of the processing solutions used in the foregoing steps are as follows:

(Color Developer)

| | Tank solution | Replenisher |
|---|---|---|
| Diethylenetriaminepentaacetic acid | 2.0 g | 4.0 g |
| Sodium 4,5-dihydroxybenzene-1,3-disulfonate | 0.4 g | 0.5 g |
| Disodium-N,N-bis(sulfonatoethyl)-hydroxylamine | 10.0 g | 15.0 g |
| Sodium sulfite | 4.0 g | 9.0 g |
| Potassium bromide | 1.4 g | — |
| 4-Amino-3-methyl-N-ethyl-N-(β-hydroxyethyl) aniline sulfate | 4.7 g | 11.4 g |
| Potassium carbonate | 39 g | 59 g |
| Diethylene glycol | 10.0 g | 17.0 g |
| Ethyleneurea | 3.0 g | 5.5 g |
| Hydroxylamine sulfate | 2.0 g | 4.0 g |
| Water to make | 1.0 L | 1.0 L |
| pH (adjusted with sulfuric acid and KOH) | 10.05 | 10.05 |
| (Bleaching Solution) | | |
| Sodium iron (III) 1,3-diaminopropane-tetraacetate monohydrate | 120 g | 180 g |
| Ammonium bromide | 70 g | 70 g |
| Succinic acid | 30 g | 50 g |
| Maleic acid | 40 g | 60 g |
| Imidazole | 20 g | 30 g |
| Water to make | 1.0 L | 1.0 L |
| pH (adjusted with aqueous ammonia and nitric acid) | 4.6 | 4.0 |
| (Fixing Solution) | | |
| Aqueous ammonium thiosulfate solution (750 g/L) | 280 ml | 750 ml |
| Aqueous ammonium bisulfite solution (72%) | 20 g | 80 g |
| Imidazole | 5 g | 45 g |
| 1-Mercapto-2-(N,N-dimethylamino-ethyl) tetrazole | 1 g | 3 g |
| Ethylenediaminetetraacetic acid | 8 g | 12 g |
| Water to make | 1 L | 1 L |
| pH (adjusted with aqueous ammonia and nitric acid) | 7.0 | 7.0 |

| | Tanksoln. = Replenisher |
|---|---|
| (Rinsing Solution) | |
| Sodium p-toluenesulfinate | 0.03 g |
| Compound of formula (I) or Comparative Compound | (See Table 3) |
| Compound of formula (II) | (See Table 3) |
| Disodium ethylenediaminetetraacetate | 0.05 g |
| 1,2-Benzoisothiazoline-3-one | 0.10 g |
| Water to make | 1.0 L |
| pH | 8.5 |

TABLE 3

| | Compound of formula (I) or Comparative compound | | Compound of formula (II) | | |
|---|---|---|---|---|---|
| Standard | Denotation | Concentration | Denotation | Concentration | Remarks |
| 1 | a | 0.5 g/L | — | — | comparison |
| 2 | a | 0.5 g/L | II-16 | 1.5 g/L | comparison |
| 3 | b | 0.5 g/L | — | — | comparison |
| 4 | c | 0.5 g/L | — | — | comparison |
| 5 | I-1 | 0.5 g/L | — | — | invention |
| 6 | I-1 | 0.5 g/L | II-16 | 1.5 g/L | invention |
| 7 | I-1 | 0.5 g/L | II-1 | 1.5 g/L | invention |
| 8 | I-1 | 0.5 g/L | II-2 | 1.5 g/L | invention |
| 9 | I-6 | 0.5 g/L | — | — | invention |
| 10 | I-6 | 0.5 g/L | II-16 | 1.5 g/L | invention |
| 11 | I-12 | 0.5 g/L | — | — | invention |
| 12 | I-12 | 0.5 g/L | — | — | invention |
| 13 | I-12 | 0.5 g/L | — | — | invention |
| 14 | I-12 | 0.5 g/L | II-16 | 0.5 g/L | invention |
| 15 | I-12 | 0.5 g/L | II-16 | 2.5 g/L | invention |
| 16 | I-12 | 0.5 g/L | II-16 | 5.0 g/L | invention |
| 17 | I-18 | 0.5 g/L | II-16 | 1.5 g/L | invention |
| 18 | I-18 | 0.5 g/L | II-16 | 1.5 g/L | invention |

(notes)
a: $C_7H_{15}$—$(OC_2H_4)_{10}$—OH
b: $C_{15}H_{31}$—$(OC_2H_4)_{10}$—OH
c: $C_{18}H_{35}$—$(OC_2H_4)_{20}$—OH

[4] Tests and Test Results

On the sample processed after running processing for 4 successive weeks under each of the processing conditions described in [3], performance evaluation of each rinsing bath and safety assessment of each rinsing bath for automatic processor members susceptible to embrittlement were carried out. As evaluation items of basic characteristics of each rinsing bath, contamination and adhesion marks on the photosensitive material surface and a drying speed of the photosensitive material after each rinse processing were taken up.

The contamination on the photosensitive material surface having received each photographic processing was evaluated by visual observation. When no aberration in surface condition was observed, the decision about surface contamination was symbolized by a mark "○". When the aberration observed in surface condition was slight and acceptable, the decision about surface contamination was symbolized by a mark "Δ". And when the aberration on an unacceptable level was noticed, the decision about surface contamination was symbolized by a mark "X".

As an evaluation measure of the drying speed was adopted the time required for changing the surface temperature of the photosensitive material to 35° C. under a condition that the photosensitive material after processing was immersed again in each rinsing bath for 60 seconds, and exposed to hot air of 60° C. immediately after it was taken out from the rinsing bath.

The adhesion resistance was determined as follows: The photosensitive material after processing was cut in rectangular pieces 5 cm long. Five of these pieces were stacked up, and thereon a load of 50 g/cm$^2$ was imposed. And the stack was allowed to stand for 3 days in the atmosphere of 35° C.–80% RH as the load was imposed thereon. Then, whether or not there was adhesion between the facing surfaces of stacked pieces was determined. The case where no aberration was noticed was symbolized by a mark "○", the case where slight adhesion was observed but it was on an acceptable level was symbolized by a mark "Δ", and the case where the adhesion on an unacceptable level was observed was symbolized by a mark "X".

Whether or not the embrittlement of piping members was caused by each rinsing bath was determined as follows.

The piping members of the automatic processor used were immersed in each concentrated solution that has 16 times as concentration as the rinsing solution having the above-mentioned composition and was kept at 50° C. for two weeks. Thereafter, the contamination and embrittlement conditions of the members' surfaces were determined by visual observation. Therein, the case where no aberration was noticed was symbolized by a mark "○", the case where slight aberration was observed but it was on an acceptable level was symbolized by a mark "Δ", and the case where the aberration on an unacceptable level was observed was symbolized by a mark "X".

The evaluation results of all items are shown in Table 4.

As can be seen from Table 4, the comparative compound a, wherein the number of carbon atoms in the alkyl moiety of the polyoxyethylene alkyl ether is smaller than that in the alkyl moiety specified in the present formula (I), and the comparative compounds b and c, wherein the number of carbon atoms in the alkyl moiety is greater than that in the alkyl moiety specified in the present formula (I), were not safe from making the piping members brittle, and produced no effect on improvement by further addition of the compound represented by formula (II) (Standards 1 to 4). On the other hand, it has been shown that Standards 5 to 18 according to the invention, wherein the polyoxyethylene alkyl ether satisfying the condition specified in formula (I) and the compound of formula (II) were contained in combination, were all safe for making the piping members brittle, and besides, fulfilled performance requirements for rinsing baths. Specifically, the present rinsing baths caused neither contamination nor adhesion on the sensitive material surface, and achieved reduction in drying speed.

TABLE 4

| Standard | Members' surfaces | Contamination of sensitive material | Drying speed | Adhesion | Remarks |
|---|---|---|---|---|---|
| 1 | X | Δ | 67 sec | X | comparison |
| 2 | X | X | 70 sec | X | comparison |
| 3 | X | X | 75 sec | X | comparison |
| 4 | X | ○ | 78 sec | Δ | comparison |
| 5 | Δ | ○ | 58 sec | ○ | invention |
| 6 | ○ | ○ | 48 sec | ○ | invention |
| 7 | ○ | ○ | 50 sec | ○ | invention |
| 8 | ○ | ○ | 49 sec | Δ | invention |
| 9 | Δ | ○ | 59 sec | Δ | invention |
| 10 | ○ | ○ | 56 sec | ○ | invention |
| 11 | Δ | ○ | 56 sec | Δ | invention |
| 12 | ○ | ○ | 48 sec | ○ | invention |
| 13 | ○ | ○ | 49 sec | ○ | invention |
| 14 | Δ | ○ | 70 sec | ○ | invention |
| 15 | ○ | ○ | 43 sec | ○ | invention |
| 16 | ○ | ○ | 63 sec | Δ | invention |
| 17 | ○ | ○ | 54 sec | ○ | invention |
| 18 | ○ | ○ | 58 sec | ○ | invention |

The present rinse-processing composition containing a polyleneglycol alkyl ether represented by formula (I) but containing neither aldehyde compound nor hexamethylenetetramine derivative is free of substances adversely affecting environmental safety, such as formaldehyde and nonylphenoxy group-containing compounds, and enables consistent processing because it has little fear of causing degradation of automatic processor members.

Therefore, the present processing composition can be fed to a rinsing tank directly from a dispenser thereof with high accuracy. Further, it is advantageous to use the present processing composition in rapid processing, such as high temperature processing which tends to accelerate deterioration of materials. In particular, environmentally safe rapid processing of color negative films can be performed effectively in accordance with the invention.

The entire disclosure of each and every foreign patent application from which the benefit of foreign priority has been claimed in the present application is incorporated herein by reference, as if fully set forth.

What is claimed is:

1. A rinse-processing composition for processing a silver halide color photographic material, and suitable for use with a plastic or rubber piping material, which comprises a concentrated liquid processing chemical containing at least one compound represented by formula (I), wherein the concentration of the formula (I) compound is from 5.0 to 100 g/l, and wherein the composition is free of both aldehyde compounds and hexamethylenetetramine derivatives:

$$R—(OC_2H_4)_n—OH \quad (I)$$

wherein R represents an alkyl group containing 8 to 10 carbon atoms, and n represents an integer of 10 to 30, wherein the composition further comprises at least one bactericide selected from the group consisting of a dichloroisocyanuric acid, a 1,2-benzoisothiazoline-3-one, an isothiazolone, and a 1-(2,4-dichlorophenyl)-2-(2-propenyloxy)ethyl-1H-imidazole.

2. A rinse-processing composition for processing a silver halide color photographic material, which comprises a concentrated liquid processing chemical containing at least one compound represented by formula (I), wherein the concentration of the formula (I) compound is from 5.0 to 100 g/l, and wherein the composition is free of both aldehyde compounds and hexamethylenetetramine derivatives:

$$R—(OC_2H_4)_n—OH \quad (I)$$

wherein R represents an alkyl group containing 8 to 10 carbon atoms, and n represents an integer of 10 to 30, wherein the composition further comprises at least one bactericide selected from the group consisting of a dichloroisocyanuric acid, a 1,2-benzoisothiazoline-3-one, an isothiazolone, and a 1-(2,4-dichlorophenyl)-2-(2-propenyloxy)ethyl-1H-imidazole, wherein the composition further comprises at least one compound represented by formula (II):

(II)

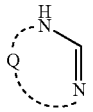

wherein Q represents non-metal atoms for forming a 5-membered ring that is unsubstituted or substituted with a substituent selected from 1–8C alkyl groups, 2–8C alkenyl groups, 1–8C alkoxy groups, 6–8C aryl groups, 7–8C aralkyl groups, 1–8C allyl groups, a hydroxyl group, a carboxyl group, a sulfo group and a moiety forming a benzene ring by fusing with the 5-membered ring, and the substituent may further be substituted with a methoxy group, an ethoxy group, a hydroxyl group, a carboxyl group and/or a sulfo group.

3. The rinse-processing composition for processing a silver halide color photographic material as described in claim 2, wherein 5-membered ring in the formula (II) is an imidazole ring, a 2-imidazoline ring, a 1H-1,2,4-triazole ring, a 1H-1,2,3-triazole ring, a 2H-1,2,3-triazole ring, a 4H-1,2,4-triazole ring, a tetrazole ring, a thiadiazole ring, an oxadiazole ring or a selenadiazole ring.

4. A method for processing a silver halide color photographic material, which comprises processing the silver halide color photographic material with an automatic processor for processing a silver halide color photographic material, which has a mechanism for performing a replenishment of a rinsing solution by feeding a rinse-processing composition as described in claim 1 and dilution water independently to a rinsing tank directly, wherein a rinse-processing composition as described in claim 1 is used at a rinsing step.

5. A method for processing a silver halide color photographic material, which comprises processing the silver halide color photographic material with an automatic processor for processing a silver halide color photographic material, which has a mechanism for performing a replenishment of a rinsing solution by feeding a rinse-processing composition as described in claim 2 and dilution water independently to a rinsing tank directly, wherein a rinse-processing composition as described in claim 2 si used at a rinsing step.

6. The method for processing a silver halide color photographic material as described in claim 4, wherein the silver halide color photographic material is a color photographic material for picture taking.

7. The method for processing a silver halide color photographic material as described in claim 6, wherein the color photographic material for picture taking is a color negative photographic material.

8. A method for processing a silver halide color photographic material, which comprises the silver halide color photographic material with a rinsing solution prepared by dilution of the rinse-processing composition according to claim 1 with water.

9. A method for processing a silver halide color photographic material, which comprises the silver halide color photographic material with a rinsing solution prepared by dilution of the rinse-processing composition according to claim 2 with water.

10. The rinse-processing composition for processing a silver halide color photographic material as described in claim 1, further comprising an EDTA or an ethylenediamine-disuccinic acid.

* * * * *